US007390956B2

(12) United States Patent
Fujiwara

(10) Patent No.: US 7,390,956 B2
(45) Date of Patent: Jun. 24, 2008

(54) AUTOMATIC PLAYER MUSICAL INSTRUMENT, NOISE SUPPRESSOR INCORPORATED THEREIN, METHOD USED THEREIN AND COMPUTER PROGRAM FOR THE METHOD

(75) Inventor: Yuji Fujiwara, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 449 days.

(21) Appl. No.: 10/971,283

(22) Filed: Oct. 21, 2004

(65) Prior Publication Data

US 2005/0092160 A1 May 5, 2005

(30) Foreign Application Priority Data

Nov. 4, 2003 (JP) ..... 2003-374315

(51) Int. Cl.
*G10F 1/02* (2006.01)

(52) U.S. Cl. ..... 84/615; 84/653; 84/13

(58) Field of Classification Search ..... 84/615, 84/653, 13, 21, 20
See application file for complete search history.

(56) References Cited

U.S. PATENT DOCUMENTS 5,254,804 A * 10/1993 Tamaki et al. ..... 84/626
5,652,399 A 7/1997 Fujiwara et al.
5,691,489 A * 11/1997 Fujiwara et al. ..... 84/21
6,051,762 A * 4/2000 Fujiwara et al. ..... 84/21
6,111,174 A * 8/2000 Oba et al. ..... 84/21

FOREIGN PATENT DOCUMENTS

JP 7-175472 7/1995

* cited by examiner

*Primary Examiner*—Lincoln Donovan
*Assistant Examiner*—David S. Warren
(74) *Attorney, Agent, or Firm*—Morrison & Foerster LLP

(57) ABSTRACT

Black/white keys are selectively moved by key actuators energized with a driving signal in a playback mode, and plunger sensors, which are provided inside of the key actuators, report the measured values of the keystroke to a motion controlling section; since the measured values contain error due to the deformation of the keys, the motion controlling section estimates true values or estimated values of the keystroke by dividing the sum of products between the measured values and weighting factors by a normalizing constant, and compares the estimated values with target values to see whether or not the keys exactly travel on reference trajectories; if the answer is negative, the motion controlling section varies the duty ratio of the driving signal so as to accelerate or decelerate the keys.

13 Claims, 11 Drawing Sheets

2-DEGREE POLYNOMIAL

| DOMAIN, m | 2 | 3 | 4 | 5 | 6 | 7 | 8 | 9 | 10 |
|---|---|---|---|---|---|---|---|---|---|
| SAMPLES n | 5 | 7 | 9 | 11 | 13 | 15 | 17 | 19 | 21 |
| NORMAL.CON WV | 70 | 28 | 4620 | 4290 | 2002 | 61880 | 7752 | 67830 | 336490 |
| WEIGHTING FACTOR j | wVj | wVj | wVj | wVj | wVj | wVj | wVj | wVj | wVj |
| -10 | | | | | | | | | 14630 |
| -9 | | | | | | | | 3519 | 9367 |
| -8 | | | | | | | 488 | 2108 | 4704 |
| -7 | | | | | | 4823 | 267 | 877 | 641 |
| -6 | | | | | 198 | 2314 | 78 | -174 | -2822 |
| -5 | | | | 555 | 77 | 225 | -79 | -1045 | -5685 |
| -4 | | | 812 | 144 | -20 | -1444 | -204 | -1736 | -7948 |
| -3 | | 7 | 49 | -167 | -93 | -2693 | -297 | -2247 | -9611 |
| -2 | 26 | -2 | -474 | -378 | -142 | -3522 | -358 | -2578 | -10674 |
| -1 | -27 | -7 | -757 | -489 | -167 | -3931 | -387 | -2729 | -11137 |
| 0 | -40 | -8 | -800 | -500 | -168 | -3920 | -384 | -2700 | -11000 |
| 1 | -13 | -5 | -603 | -411 | -145 | -3489 | -349 | -2491 | -10263 |
| 2 | 54 | 2 | -166 | -222 | -98 | -2638 | -282 | -2102 | -8926 |
| 3 | | 13 | 511 | 67 | -27 | -1367 | -183 | -1533 | -6989 |
| 4 | | | 1428 | 456 | 68 | 324 | -52 | -784 | -4452 |
| 5 | | | | 945 | 187 | 2435 | 111 | 145 | -1315 |
| 6 | | | | | 330 | 4966 | 306 | 1254 | 2422 |
| 7 | | | | | | 7917 | 533 | 2543 | 6759 |
| 8 | | | | | | | 792 | 4012 | 11696 |
| 9 | | | | | | | | 5661 | 17233 |
| 10 | | | | | | | | | 23370 |
| Sum | 0 | 0 | 0 | 0 | 0 | 0 | 0 | 0 | 0 |

Fig. 1

2-DEGREE POLYNOMIAL

| DOMAIN | m | 2 | 3 | 4 | 5 | 6 | 7 | 8 | 9 | 10 |
|---|---|---|---|---|---|---|---|---|---|---|
| SAMPLES | n | 5 | 7 | 9 | 11 | 13 | 15 | 17 | 19 | 21 |
| NORMAL.CONST. | WX | 35 | 42 | 165 | 143 | 91 | 340 | 969 | 665 | 1771 |
| WEIGHTING FACTOR | j | wXj | wXj | wXj | wXj | wXj | wXj | wXj | wXj | wxj |
| | -10 | | | | | | | | | 171 |
| | -9 | | | | | | | | 68 | 99 |
| | -8 | | | | | | | 105 | 36 | 37 |
| | -7 | | | | | | 39 | 49 | 9 | -15 |
| | -6 | | | | | 11 | 15 | 3 | -13 | -57 |
| | -5 | | | | 18 | 3 | -4 | -33 | -30 | -89 |
| | -4 | | | 21 | 2 | -3 | -18 | -59 | -42 | -111 |
| | -3 | | 5 | -3 | -9 | -7 | -27 | -75 | -49 | -123 |
| | -2 | 3 | -3 | -17 | -15 | -9 | -31 | -81 | -51 | -125 |
| | -1 | -5 | -6 | -21 | -16 | -9 | -30 | -77 | -48 | -117 |
| | 0 | -3 | -4 | -15 | -12 | -7 | -24 | -63 | -40 | -99 |
| | 1 | 9 | 3 | 1 | -3 | -3 | -13 | -39 | -27 | -71 |
| | 2 | 31 | 15 | 27 | 11 | 3 | 3 | -5 | -9 | -33 |
| | 3 | | 32 | 63 | 30 | 11 | 24 | 39 | 14 | 15 |
| | 4 | | | 109 | 54 | 21 | 50 | 93 | 42 | 73 |
| | 5 | | | | 83 | 33 | 81 | 157 | 75 | 141 |
| | 6 | | | | | 47 | 117 | 231 | 113 | 219 |
| | 7 | | | | | | 158 | 315 | 156 | 307 |
| | 8 | | | | | | | 409 | 204 | 405 |
| | 9 | | | | | | | | 257 | 513 |
| | 10 | | | | | | | | | 631 |
| | Sum | 35 | 42 | 165 | 143 | 91 | 340 | 969 | 665 | 1771 |

Fig. 2

3-DEGREE POLYNOMIAL

| DOMAIN | m | 2 | 3 | 4 | 5 | 6 | 7 | 8 | 9 | 10 |
|---|---|---|---|---|---|---|---|---|---|---|
| SAMPLES | n | 5 | 7 | 9 | 11 | 13 | 15 | 17 | 19 | 21 |
| NORMAL. CONST. | WA | 7 | 42 | 1386 | 858 | 2002 | 55692 | 3876 | 298452 | 302841 |
| WEIGHTING FACTOR | j | wAj | wAj | wAj | wAj | wAj | wAj | wAj | wAj | wAj |
| | -10 | | | | | | | | | -8265 |
| | -9 | | | | | | | | -10608 | -2793 |
| | -8 | | | | | | | -184 | -2788 | 1158 |
| | -7 | | | | | | -3640 | -31 | 2600 | 3763 |
| | -6 | | | | | -187 | -169 | 68 | 5871 | 5197 |
| | -5 | | | | -120 | 22 | 1886 | 121 | 7340 | 5635 |
| | -4 | | | -308 | 42 | 130 | 2770 | 136 | 7322 | 5252 |
| | -3 | | -16 | 217 | 108 | 158 | 2728 | 121 | 6132 | 4223 |
| | -2 | -5 | 21 | 340 | 103 | 127 | 2005 | 84 | 4085 | 2723 |
| | -1 | 13 | 18 | 201 | 52 | 58 | 846 | 33 | 1496 | 927 |
| | 0 | -2 | -4 | -60 | -20 | -28 | -504 | -24 | -1320 | -990 |
| | 1 | -15 | -24 | -303 | -88 | -110 | -1800 | -79 | -4048 | -2853 |
| | 2 | 9 | -21 | -388 | -127 | -167 | -2797 | -124 | -6373 | -4487 |
| | 3 | | 26 | -175 | -112 | -178 | -3250 | -151 | -7980 | -5717 |
| | 4 | | | 476 | -18 | -122 | -2914 | -152 | -8554 | -6368 |
| | 5 | | | | 180 | 22 | -1544 | -119 | -7780 | -6265 |
| | 6 | | | | | 275 | 1105 | -44 | -5343 | -5233 |
| | 7 | | | | | | 5278 | 81 | -928 | -3097 |
| | 8 | | | | | | | 264 | 5780 | 318 |
| | 9 | | | | | | | | 15096 | 5187 |
| | 10 | | | | | | | | | 11685 |
| | Sum | 0 | 0 | 0 | 0 | 0 | 0 | 0 | 0 | 0 |

Fig. 3

3-DEGREE POLYNOMIAL

| DOMAIN | m | 2 | 3 | 4 | 5 | 6 | 7 | 8 | 9 | 10 |
|---|---|---|---|---|---|---|---|---|---|---|
| SAMPLES | n | 5 | 7 | 9 | 11 | 13 | 15 | 17 | 19 | 21 |
| NORMAL.CONST. | WV | 84 | 252 | 8316 | 2574 | 24024 | 334152 | 23256 | 81396 | 3634092 |
| WEIGHTING FACTOR | j | wVj | wVj | wVj | wVj | wVj | wVj | wVj | wVj | wVj |
| | -10 | | | | | | | | | -309225 |
| | -9 | | | | | | | | -8058 | -85728 |
| | -8 | | | | | | | -2708 | -1564 | 70476 |
| | -7 | | | | | | -46319 | -242 | 2738 | 167584 |
| | -6 | | | | | -4015 | 2158 | 1277 | 5149 | 213793 |
| | -5 | | | | -525 | 924 | 29047 | 1998 | 5970 | 217300 |
| | -4 | | | -2086 | 258 | 3246 | 38324 | 2070 | 5502 | 186302 |
| | -3 | | -77 | 1862 | 529 | 3532 | 33965 | 1642 | 4046 | 128996 |
| | -2 | -29 | 122 | 2441 | 431 | 2363 | 19946 | 863 | 1903 | 53579 |
| | -1 | 88 | 77 | 918 | 107 | 320 | 243 | -118 | -626 | -31752 |
| | 0 | -48 | -72 | -1440 | -300 | -2016 | -21168 | -1152 | -3240 | -118800 |
| | 1 | -136 | -185 | -3366 | -647 | -4064 | -40311 | -2090 | -5638 | -199368 |
| | 2 | 125 | -122 | -3593 | -791 | -5243 | -53210 | -2783 | -7519 | -265259 |
| | 3 | | 257 | -854 | -589 | -4972 | -55889 | -3082 | -8582 | -308276 |
| | 4 | | | 6118 | 102 | -2670 | -44372 | -2838 | -8526 | -320222 |
| | 5 | | | | 1425 | 2244 | -14683 | -1902 | -7050 | -292900 |
| | 6 | | | | | 10351 | 37154 | -125 | -3853 | -218113 |
| | 7 | | | | | | 115115 | 2642 | 1366 | -87664 |
| | 8 | | | | | | | 6548 | 8908 | 106644 |
| | 9 | | | | | | | | 19074 | 373008 |
| | 10 | | | | | | | | | 719625 |
| | Sum | 0 | 0 | 0 | 0 | 0 | 0 | 0 | 0 | 0 |

Fig. 4

3-DEGREE POLYNOMIAL

| DOMAIN | m | 2 | 3 | 4 | 5 | 6 | 7 | 8 | 9 | 10 |
|---|---|---|---|---|---|---|---|---|---|---|
| SAMPLES | n | 5 | 7 | 9 | 11 | 13 | 15 | 17 | 19 | 21 |
| NORMAL.CONST. | WX | 70 | 42 | 99 | 143 | 364 | 3060 | 969 | 1463 | 10626 |
| WEIGHTING FACTOR | j | wXj | wXj | wXj | wXj | wXj | wXj | wXj | wXj | wXj |
| | -10 | | | | | | | | | -969 |
| | -9 | | | | | | | | -136 | -204 |
| | -8 | | | | | | | -91 | -16 | 306 |
| | -7 | | | | | | -286 | 0 | 59 | 596 |
| | -6 | | | | | -33 | 44 | 52 | 96 | 701 |
| | -5 | | | | -12 | 12 | 209 | 72 | 102 | 656 |
| | -4 | | | -7 | 8 | 30 | 244 | 67 | 84 | 496 |
| | -3 | | -2 | 8 | 13 | 28 | 184 | 44 | 49 | 256 |
| | -2 | -1 | 4 | 8 | 8 | 13 | 64 | 10 | 4 | -29 |
| | -1 | 4 | 1 | 0 | -2 | -8 | -81 | -28 | -44 | -324 |
| | 0 | -6 | -4 | -9 | -12 | -28 | -216 | -63 | -88 | -594 |
| | 1 | 4 | -4 | -12 | -17 | -40 | -306 | -88 | -121 | -804 |
| | 2 | 69 | 8 | -2 | -12 | -37 | -316 | -96 | -136 | -919 |
| | 3 | | 39 | 28 | 8 | -12 | -211 | -80 | -126 | -904 |
| | 4 | | | 85 | 48 | 42 | 44 | -33 | -84 | -724 |
| | 5 | | | | 113 | 132 | 484 | 52 | -3 | -344 |
| | 6 | | | | | 265 | 1144 | 182 | 124 | 271 |
| | 7 | | | | | | 2059 | 364 | 304 | 1156 |
| | 8 | | | | | | | 605 | 544 | 2346 |
| | 9 | | | | | | | | 851 | 3876 |
| | 10 | | | | | | | | | 5781 |
| | Sum | 70 | 42 | 99 | 143 | 364 | 3060 | 969 | 1463 | 10626 |

Fig. 5

AUTOMATIC PLAYER MUSICAL INSTRUMENT, NOISE SUPPRESSOR INCORPORATED THEREIN, METHOD USED THEREIN AND COMPUTER PROGRAM FOR THE METHOD

FIELD OF THE INVENTION

This invention relates to a noise suppressing technology and, more particularly, to an automatic player keyboard musical instrument, a noise suppressor incorporated in the automatic player keyboard musical instrument, a method for suppressing noise and a computer program representative of the method.

DESCRIPTION OF THE RELATED ART

An automatic player piano is the combination of an acoustic piano and an automatic playing system. While a pianist is fingering a piece of music on the acoustic piano, the piano tones are generated through the acoustic piano, and the automatic playing system stands idle. The behavior of the automatic player piano is hereinafter referred to as an "acoustic mode of operation". On the other hand, while music data codes, which represent a piece of music, are being sequentially supplied to the automatic playing system, the automatic playing system analyzes the music data codes, and sequentially gives rise to the key motion for generating the piano tones along the music passage without any fingering of a human player. The behavior of the automatic player piano is hereinafter referred to as an "automatic playing mode of operation".

A typical example of the automatic player piano is disclosed in Japanese Patent Application laid-open No. Hei 7-175472. An automatic playing system is incorporated in the prior art automatic player piano disclosed in the Japanese Patent Application laid-open, and includes solenoid-operated key actuators with built-in plunger sensors and a controller. The solenoid-operated key actuators are provided under the black keys and white keys, and have respective solenoids, which are connected to the controller, and respective plungers projectable from and retractable into the associated solenoids.

The solenoids are selectively energized with a driving pulse signal in the automatic playing mode so as to create the magnetic field around the associated plungers. Then, the plungers project from the associated solenoids, and upwardly push the associated black/white keys. Thus, the plungers give rise to the key motion without any fingering of a human pianist.

The plungers are monitored with the built-in plunger sensors, and the actual plunger position is fed back to the controller. The controller has determined reference trajectories, i.e., a series of target plunger positions in terms of time for the black/white keys on the basis of the music data codes representative of the note-on events.

While the plunger is projecting from the associated solenoid, the controller compares the target plunger positions with the actual plunger positions to see whether or not the plunger is exactly moved on the reference trajectory. When the controller finds the plunger on the reference trajectory, the controller keeps the driving pulse signal. However, if the controller finds the plunger to be advanced or delayed, the controller varies the driving pulse signal so as to force the plunger to move on the reference trajectory. The reference trajectory is identical with the trajectory on which the black/white key was traveling in the original performance. For this reason, if the controller keeps the plunger on the reference trajectory, the plunger gives the key velocity equal to that in the original performance to the associated black/white key. This results in that the string is struck with the hammer at the intensity equal to that in the original performance. This results in the piano tone same as that in the original performance.

A problem is encountered in the prior art automatic player piano in that, even if the controller forces the plungers to move on the reference trajectories, the piano tones are generated through some acoustic pianos at loudness different from that in the original performance.

SUMMARY OF THE INVENTION

It is therefore an important object of the present invention to provide an automatic player keyboard musical instrument, which produces tones at loudness to be expected in the automatic playing mode.

It is another important object to provide a noise suppressor, which makes the automatic player keyboard musical instrument to produce the tones at the loudness.

It is yet another important object of the present invention to provide a method employed in the noise suppressor.

It is still another important object of the present invention to provide a computer program representing the method.

The present inventor contemplated the problem inherent in the prior art automatic player piano, and noticed the finished dimensions of the component parts of the acoustic pianos seriously dispersed. Moreover, the present inventor noticed several component parts differently deformed in the transmission of force from the black/white keys to the associated hammers. For example, the wooden keys and felt were deformed. Even when force was exerted on a component part at different points, the deformation was different depending upon the point where the force was exerted. These phenomena resulted in error components introduced into the reference trajectories.

The present inventor searched databases for error suppressing techniques, and found an error suppressing technique in "Processing on Waveform Data for Scientific Measurement" written by Sigeo MINAMI and published by CQ Publishing Company. MINAMI taught how to eliminate noise component from sampling data. According to the book, when a series of measured values were sampled, the noise component was estimated through a convolution between the measured values and corresponding weighting factors for the measured value at the center of the series. The noise component at the center was less convenient, because it is necessary to determine the noise component for the latest measured value on the basis of the noise at the center of the series.

To accomplish the object, the present invention proposes to mathematically suppress the errors.

In accordance with one aspect of the present invention, there is provided a musical instrument for producing tones comprising an acoustic musical instrument including plural manipulators respectively assigned pitch names and selectively moved for designating the pitch names of the tones to be produced and plural tone generating units connected to the plural manipulators and producing the tones designated by means of the moved manipulators, and an electronic system including plural actuators respectively provided for the plural manipulators and selectively activated with a driving signal so as to give rise to motion of the plural manipulators, plural sensors measuring a physical quantity expressing the motion of the plural manipulators and producing detecting signals representative of measured values of the physical quantity, a preliminary processing section supplied with pieces of music data, and determining reference trajectories on the basis of the pieces of music data for the manipulators to be moved and a motion controlling section connected to the preliminary processing section for receiving pieces of control data representative of the reference trajectories, the plural sensors for receiving the detecting signals and the plural actuators for supplying the driving signal thereto and varying a magnitude of the driving signal so as to accelerate and decelerate the manipulators, if necessary, thereby forcing the manipulators to move on the reference trajectories, in which the motion controlling section determines the latest estimated value of the physical quantity by calculating a sum of products between the measured values and weighting factors for each of the manipulators moved on the reference trajectories, and in which the motion controlling section compares the latest estimated value with a corresponding target value on the reference trajectory for the aforesaid each of the manipulators to see whether or not the driving signal is to be varied in magnitude.

In accordance with another aspect of the present invention, there is provided a noise suppressor noise suppressor for eliminating a noise component from measured values of a physical quantity supplied thereto at time intervals comprising a temporary data storage having a predetermined number of locations where the measured values are respectively stored in the order of arrival, an estimator determining an estimated value for the latest measured value of the physical quantity by calculating a sum of products between the measured values stored in the temporary data storage and weighting factors so that at least part of a noise component is given as the difference from the measured value, and a data storage controller removing the earliest measured value from the temporary data storage so as to store a new measured value therein as the latest measured value.

In accordance with yet another aspect of the present invention, there is provided a method for suppressing a noise component comprising the steps of storing a new measured value of a physical quantity as the latest measured value in a temporary data storage where measured values of the physical quantity are stored as earlier measured value, determining an estimated value for the latest measured value by calculating a sum of products between the measured values stored in the temporary data storage and weighting factors so that at least part of a noise component is given as the difference from the measured value, and repeating the previous two steps so that the estimated values are successively determined for the new measured values.

In accordance with still another aspect of the present invention, there is provided a computer program expressing a method for suppressing a noise component, and the method comprises the steps of storing a new measured value of a physical quantity as the latest measured value in a temporary data storage where measured values of the physical quantity are stored as earlier measured value, determining an estimated value for the latest measured value by calculating a sum of products between the measured values stored in the temporary data storage and weighting factors so that at least part of a noise component is given as the difference from the measured value and repeating the previous two steps so that the estimated values are successively determined for the new measured values.

BRIEF DESCRIPTION OF THE DRAWINGS

The features and advantages of the automatic player keyboard musical instrument, noise suppressor, method and computer program will be more clearly understood from the following description taken in conjunction with the accompanying drawings, in which FIG. 1 is a table showing a weighting factor and a normalizing constant in terms of samples for estimated values of a velocity at the end of the samples, FIG. 2 is a table showing a weighting factor and a normalizing constant in terms of samples for estimated values of the stroke at the end of the samples, FIG. 3 is a table showing a weighting factor and normalizing constant in terms of samples for estimated values of an acceleration at the end of the samples, FIG. 4 is a table showing a weighting factor and normalizing constant in terms of samples for estimated values of a velocity at the end of the samples, FIG. 5 is a table showing a weighting factor and normalizing constant in terms of samples for estimated values of a stroke at the end of the samples.

Mathematical Analysis

Figure 6:
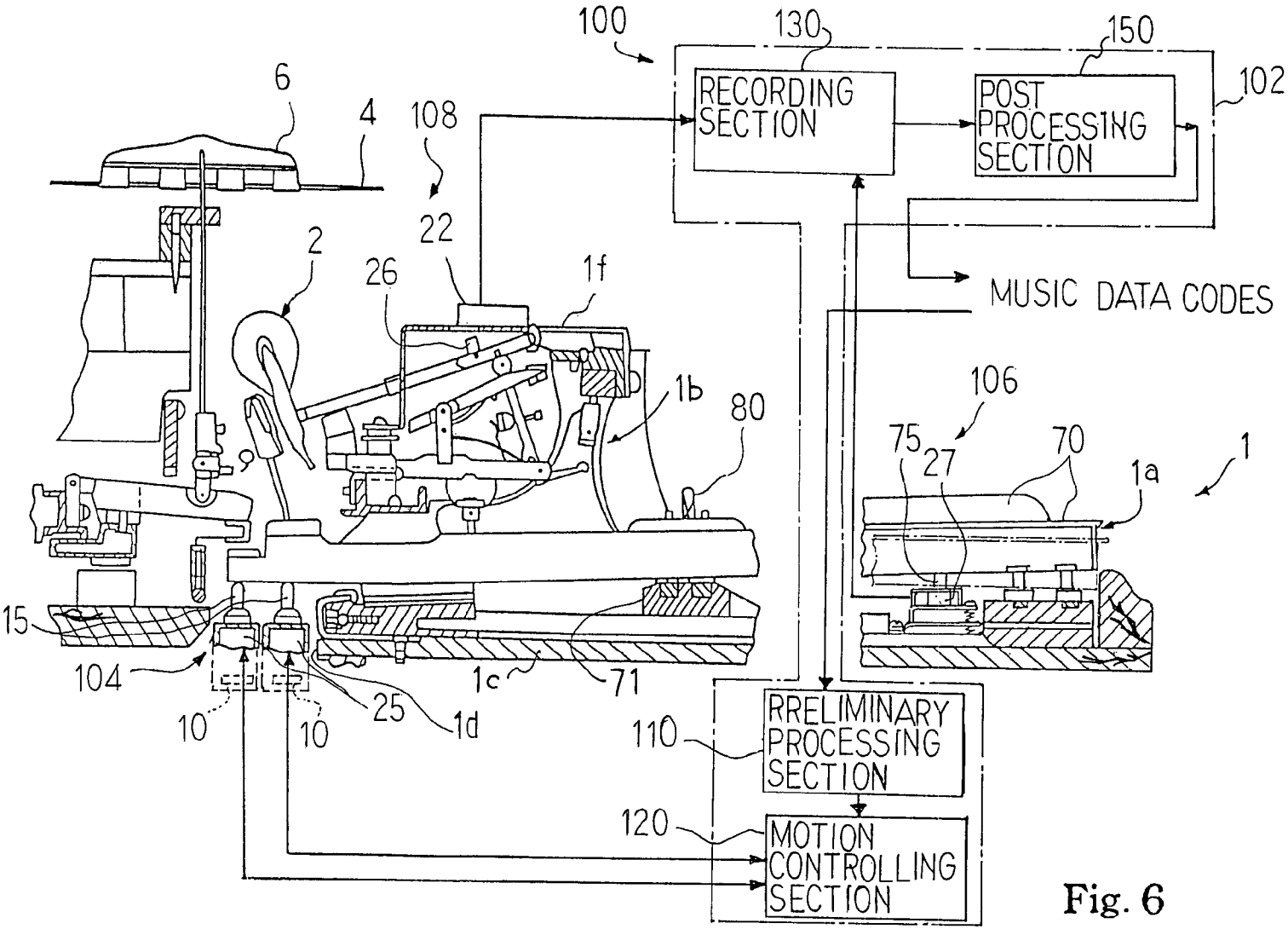
FIG. 6 is a cross-sectional side view showing the structure of an automatic player piano according to the present invention.

In the following description, a black/white key is assumed to be a moving object, measured values of which are subject to error. The black/white key forms a part of the keyboard, which is incorporated in an automatic player piano. The moving object is not restricted to the black/white key. A hammer of the acoustic piano may serve as the moving object. Nevertheless, description is made on the assumption that the black/white keys are the moving object.

In the automatic playing mode, a controller supplies a driving signal to a key actuator associated with the black/white key so that the black/white key is driven for rotation about a balance key pin. A sensor is provided for the black/white key so as to measure the stroke of the black/white key, and the measured values, which represent the stroke from the rest position, are fed back to the controller. The controller compares the measured values with corresponding target values on a reference trajectory to see whether or not the black/white key is tracing along the reference trajectory. If the black/white key is deviated from the reference trajectory, the controller varies the driving signal so as to accelerate or decelerate the black/white key.

However, error is unavoidably introduced into the measured values. The reason why the error is introduced into the measured values is that there is a play between the black/white key and the plunger of the key actuator and that the deformation of the black/white key is different between the depression with the finger of a human player and the depression with the plunger. In case where the original performance is replayed through an automatic player piano different from the automatic player piano through which the original performance was recorded. Aged deterioration is also causative of the error. Thus, error-free values, which represent the actual stroke of the black/white key, are to be estimated on the basis of the measured values.

Estimated Value of Stroke at the Center of Series of Samples

Assuming now that n measured values of stroke xj, in which j is from −m to m, are sampled from a waveform of the output signal at sampling period T, the series of measured values xj or samples is approximated to a P-degree polynomial. In case where the degree is 2, the stroke "y" is approximated as $y=a*t^2+b*t+c$ where t is the sampling time and * is the multiplication sign. If the degree is 1, the constant "a" is zero.

The constants a, b and c are determined in such a manner that the square error is minimized. The measured value at the sampling time tj is expressed as xj, and the estimated value of stroke yj is given as $yj=a*tj^2+b*tj+c$. The square error E is given as $E=SIGMA(xj-yj)^2=SIGMA(xj-a*tj^2-b*\ tj-c)^2$, and the coefficients a, b and c are determined in such a manner that the square error E is minimized. In detail, the constants a, b and c are determined in such a manner that partial differential equations $\partial E/\partial a=0$, $\partial E/\partial b=0$ and $\partial E/\partial c=0$ are satisfied. Sign "SIGMA" stands for $$\text{“}\sum_{j=-1}^{m}\text{”}.$$

It is possible to express the constants a, b and c as $$SIGMA(wj*xj))/W \qquad \text{Equation 1}$$

where wj is a weighting factor and W is a normalizing constant. In other words, the constants a, b and c are expressed as the sum of the products of the multiplication between the weighting factor wj and the measured value xj, and a trajectory at the center of the series of measured values, i.e., j=0 is estimated where j is a number assigned to the measured values in the series, i.e., j =(−m . . . , 0, . . . , m). The number of the measured values n is equal to (2m +1), and the measured values xj are sampled at (−tm, . . . , 0, . . . , m).

The constant a is determined as follows.

$$a=(SIGMA\ (waj*xj))/Wa \qquad \text{Equation 2}$$

where Wa and waj are expressed as equations 3 and 4.

$$Wa=T^2*m(m+1)(2m+1)(2m+3)(2m-1)/15 \qquad \text{Equation 3}$$

$$\begin{aligned} waj &= 3j^2 - m^2 - m \\ &= 3j^2 - m(m+1) \end{aligned} \qquad \text{Equation 4}$$

The constant b is determined as follows.

$$b=(SIGMA\ (wbj*xj))/Wb \qquad \text{Equation 5}$$

where Wb and wbj are expressed as equations 3 and 4.

$$Wb=T*m(m+1)(2m+1)/3 \qquad \text{Equation 6}$$

$$wbj=j \qquad \text{Equation 7}$$

The constant c is determined as follows.

$$c=(SIGMA\ (wcj*xj))/Wc \qquad \text{Equation 8}$$

where Wc and wcj are expressed as equations 3 and 4.

$$Wc=(2m+1)(2m+3)(2m-1)/3 \qquad \text{Equation 9}$$

$$\begin{aligned} wcj &= 3m^2 + 3m - 1 - 5j^2 \\ &= -5j^2 + 3m(m+1) - 1 \end{aligned} \qquad \text{Equation 10}$$

When j is zero, "0" is substituted for "t" in the 2-degree polynomial, and the estimated value of stroke is equal to c. Thus, the estimated value of the stroke is equal to c at the center of series.

Subsequently, description is made on an estimated value A of the acceleration, an estimated value Vc of a velocity at the center of the series of measured values, i.e., j=0, an estimated value V of the velocity at the end of the series of measured values, i.e., j=m, an estimated value Xc of a position at the center of the series of measured values, i.e., j=0 and an estimated value X of the position at the end of the series of measured values, i.e., j=m. These estimated values are expressed as $$A=2a \qquad \text{Equation 11}$$

$$Vc=b \qquad \text{Equation 12}$$

$$Xc=c \qquad \text{Equation 13}$$

$$V=Vc+A*m*T=b+2a*m*T \qquad \text{Equation 14}$$

$$\begin{aligned} X &= Xc + Vc*m*T + A/2*(m*T)^2 \\ &= c + b*m*T + a(m*T)^2 \end{aligned} \qquad \text{Equation 15}$$

Thus, the estimated values are determined on the basis of the constants a, b and c, which have been determined through the least square approximation and, the sampling period T at the center of the series and at the end of the series.

Estimated Value of Velocity for Latest Sample (2-Degree Polynomial)

In the following description, term "end" means the latest, i.e., j=m. Each measured value is firstly stored at m, and is rippled from "m" through "0" toward "−m". Thus, the latest measured value is always positioned at "m". The estimated value of the velocity V is calculated at the end of the series on the basis of the estimated value Vc at the center of the series as follows. The estimated value Vc of the velocity is equal to b. From equations 2, 5 and 14, the estimated value V of the velocity is expressed as $$\begin{aligned} V &= b + 2a*m*T \\ &= (SIGMA(wbj*xj))/Wb + 2(SIGMA(waj*xj))/Wa*m*T \end{aligned}$$

Since "j" is varied from −m to m in each SIGMA calculation, the above-described equation is modified as $$\begin{aligned} V &= SIGMA((wbj*xj)/Wb + 2waj*xj/Wa*m*T) \\ &= SIGMA((wbj*Wa/T^2 + 2waj*m*Wb/T)*xj)/ \\ &\quad (WbWa/T^2) \end{aligned} \qquad \text{Equation 21}$$

Equations 3, 4, 6 and 7 are substituted for wa, waj, wb and wbj in equation 21. The substitution results in the following denominator and numerator.

$$\text{Denominator} = T*m(m+1)(2m+1)/3*T^2*m(m+1)(2m+1)(2m+3)(2m-1)/15/T^2 = T*m^2(m+1)^2(2m+1)^2(2m+3)(2m-1)/45 \quad \text{Equation 22}$$

$$\text{Numerator} = \text{SIGMA}((j*T^2*m(m+1)(2m+1)(2m+3)(2m-1)/15/T^2 + 2(3j^2 - m(m+1))m*T*m(m+1)(2m+1)/3/T)*xj) = m(m+1)(2m+1)/15*\text{SIGMA}((30mj^2 + (2m+3)(2m-1)j - 10m^2(m+1)))*xj \quad \text{Equation 23}$$

Thus, the estimated value V is expressed as $$V=\text{SIGMA}((30mj^2+(2m+3)(2m-1)j-10m^2(m+1))*xj)/(T*m(m+1)(2m+1)(2m+3)(2m-1)/3) \quad \text{Equation 24}$$

Rewriting equation 24 into the sum of products as similar to equation 1, equation 24 is to be expressed as $$V=(\text{SIGMA}\ (wVj*xj))/WV \quad \text{Equation 25}$$

The normalizing constant WV and weighting factor wVj are expressed as follows.

$$WV=T*m(m+1)(2m+1)(2m+3)(2m-1)/3 \quad \text{Equation 26}$$

$$wVj=30mj^2+(2m+3)(2m-1)j-10m^2(m+1) \quad \text{Equation 27}$$

The normalizing constant WV and weighting factor wVj are tabled in FIG. 1. In FIG. 1, m is increased from 2 to 10 (see the first row), and, accordingly, the number of measured values or samples n is increased from 5 to 21 as shown in the second row. Equation 26 gives the normalizing constant WV as shown in the third row of the table, and the weighting factor wVj is varied together with "j" and "m". The sum of the weighting factors wVj is always zero as shown in the last row of the table.

Estimated Value of Stroke for Latest Sample (2-Degree Polynomial)

The estimated value of the position X at the end of the series is calculated through equation 15, and equations 2, 5 and 8 are substituted for a, b and c. Then, equation 15 is rewritten as $$X = c + b*m*T + a(m*T)^2 = (\text{SIGMA}(wcj*xj))/Wc + (\text{SIGMA}(wbj*xj))/Wb*m*T + (\text{SIGMA}(waj*xj))/Wa*(m*T)^2 \quad \text{Equation 30}$$

Since the domain for SIGMA, i.e., from −m to m, is same among the first term, second term and third term, equation 30 is modified as $$X = \text{SIGMA}((wcj*xj))/Wc + (wbj*xj)/Wb*m*T + (waj*xj))/Wa*(m*T)^2) \quad \text{Equation 31}$$

-continued $$= \text{SIGMA}((wcj*WbWa/T^3 + wbj*m*WcWa/T^2 + waj*m^2WcWb/T)*xj/(WcWbWa/T^3)$$

Equations 3, 4, 6, 7, 9 and 10 are substituted for Wa, waj, Wb, wbj, Wc and wcj in equation 31. Then, the denominator and numerator are rewritten as $$\text{Denominator} = (2m+1)(2m+3)(2m-1)/3*T*m(m+1)(2m+1)/3*T^2*m(m+1)(2m+1)(2m+3)(2m-1)/15/T^3 = m^2(m+1)^2(2m+1)^3(2m+3)^2(2m-1)^2/135 \quad \text{Equation 32}$$

$$\text{Numerator} = \text{SIGMA}(((-5j^2 + 3m(m+1) - 1)*T*m(m+1)(2m+1)/3*T^2*m(m+1)(2m+1)(2m+3)(2m-1)/15/T^3 + j*m*(2m+1)(2m+3)(2m-1)/3*T^2*m(m+1)(2m+1)(2m+3)(2m-1)/15/T^2 + (3j^2 - m(m+1))*m^2*(2m+1)(2m+3)(2m-1)/3*T*m(m+1)(2m+1)/3/T)*xj) = m^2(m+1)(2m+1)^2(2m+3)(2m-1)^2/45*\text{SIGMA}((5j^2 + (2m+3)j - (m+1)(m-1))*xj) \quad \text{Equation 33}$$

From equations 32 and 33, the estimated value X of the position is given as $$X=\text{SIGMA}(5j^2+(2m+3)j-(m+1)(m-1))*xj)/((m+1)(2m+1)(2m+3)/3) \quad \text{Equation 34}$$

Equation 34 is rewritten in the form of sum of products as similar to equation 1.

Equation 34 is rewritten in the form of (SIGMA (wj*xj)/W.

$$X=\text{SIGMA}(wXj*xj))/WX \quad \text{Equation 35}$$

$$WX=(m+1)(2m+1)(2m+3)/3 \quad \text{Equation 36}$$

$$wXj=5j^2+(2m+3)j-(m+1)(m-1) \quad \text{Equation 37}$$

Thus, the estimated value X is given in the form of the sum of products. The domain, i.e., m, weighting factor wXj and normalizing constant WX are tabled in FIG. 2.

3-Degree Approximation

The above-described estimated values are determined on the basis of the fact that the stroke of a key is approximated to the 2-degree polynomial. When using a 3-degree polynomial, we can approximate the stroke more precisely. The 3-degree polynomial is expressed as $$y=a*t^3+b*t^2+c*t+d \quad \text{Equation 41}$$

It is possible to determine the constants a, b, c and d through the least square approximation as similar to the 2-degree polynomial.

As to constant a, $$a=(\text{SIGMA}\ (waj*xj))/Wa \quad \text{Equation 42}$$

$$Wa=T^3*m(m+1)(m+2)(m-1)(2m+1)(2m+3)(2m-1)/35 \quad \text{Equation 43}$$

$$waj = j(5j^2 - 3m^2 - 3m + 1) \quad \text{Equation 44}$$
$$= j(5j^2 - 3m(m+1) + 1)$$

As to constant b, $$b=(\text{SIGMA } (wbj*xj))/Wb \quad \text{Equation 45}$$

$$Wb=T^2*m(m+1)(2m+1)(2m+3)(2m-1)/15 \quad \text{Equation 46}$$

$$wbj = 3j^2 - m^2 - m \quad \text{Equation 47}$$
$$= 3j^2 - m(m+1)$$

As to constant C, $$c=(\text{SIGMA } (wcj*xj))/Wc \quad \text{Equation 48}$$

$$Wc=T*m(m+1)(m+2)(m-1)(2m+1)(2m+3)(2m-1)/5 \quad \text{Equation 49}$$

$$wcj = j(15m^4 + 30m^3 - 15m + 5 - (21m^2 + 21m - 7)j^2) \quad \text{Equation 50}$$
$$= j(-7(3m(m+1) - 1)j^2 + 5(3m(m+1)(m+2)(m-1) + 1) + 1))$$

As to constant d, $$d=(\text{SIGMA } (wdj*xj))/Wd \quad \text{Equation 51}$$

$$Wd=(2m+1)(2m+3)(2m-1)/3 \quad \text{Equation 52}$$

$$wdj = 3m^2 + 3m - 1 - 5j^2 \quad \text{Equation 53}$$
$$= -5j^2 + 3m(m+1) - 1$$

The estimated value of the stroke is equal to d at the center of the series of measured values. The constant "b" expressed by equations 45, 46 and 47 is equal to the constant "a" expressed by equations 2, 3 and 4, and the constant "d" expressed by equations 51, 52 and 53 is equal to the constant "c" expressed by equations 8, 9 and 10.

Description is made on the relation between the constants a, b, c and d and estimated values J, Ac, A, Vc, V, Xc and X where

- J is the third derivative of the estimated value expressed by equation 41,
- Ac is an estimated value of an acceleration at the center of the series of measured values, i.e., j=0,
- A is an estimated value of the acceleration at the end of the series of measured values, i.e., j=m,
- Vc is an estimated value of a velocity at the center of the series of measured values, i.e., j=0,
- V is an estimated value of the velocity at the end of the series of measured values, i.e., j=m,
- Xc is an estimated value of a position at the center of the series of measured values, i.e., j=0, and
- X is an estimated value of the position at the end of the series of measured values, i.e., j=m.

The estimated values are determined as $$J=6a \quad \text{Equation 54}$$

$$Ac=2b \quad \text{Equation 55}$$

$$Vc=c \quad \text{Equation 56}$$

$$Xc=d \quad \text{Equation 57}$$

$$A=Ac+J*m*T=2b+6a*m*T \quad \text{Equation 58}$$

$$V=Vc+Ac*m*T+J/2*(m*t)^2=c+2b*m*T+3a(m*T)^2 \quad \text{Equation 59}$$

$$X = Xc + Vc*m*T + A/2\,(mT)^2 + J/\&\,(mT)^3 \quad \text{Equation 60}$$
$$= d + c*m*T + b(m*T)^2 + a(m*T)^3$$

Estimated Value of Acceleration for Latest Sample (3-Degree Polynomial)

Using the estimated value of the acceleration at the center of the measured values, i.e., j=0, we can determine an estimated value of the acceleration at the end of the series of measured values, i.e., j=m. From equations 42, 45 and 58, the estimated value of the acceleration at the end of the series is expressed as $$A = 2b + 6a*m*T \quad \text{Equation 61a}$$
$$= 2(\text{SIGMA}(wbj*xj))/Wb + 6(\text{SIGMA}(wa*xj))/Wa*m*T$$

Since the domain [−m, . . . m] for SIGMA is common to the first term and the second term, equation 61a is modified as $$A = SIGMA(2wbj*xj/Wb + 6waj*xj/Wa*m*T) \quad \text{Equation 61b}$$
$$= SIGMA((2wbj*Wa/T^3 + 6waj*m*Wb/T^2)*xj)/(WbWa/T^3)$$

Equations 43, 44, 46 and 47 are substituted for Wa, waj, Wb and wbj in equation 61. Then, the denominator and numerator are rewritten as $$\text{Denominator} = T^2*m(m+1)(2m+1)(2m+3)(2m-1)/15*T^3*m(m+1)(m+2)(m-1)(2m+1)(2m+3)(2m-1)/35/T^3 = T^2*m^2(m+1)^2(m+2)(m-1)(2m+1)^2(2m+3)^2(2m-1)^2/525 \quad \text{Equation 62}$$

$$\text{Numerator} = \text{SIGMA}((2(3j^2 - m(m+1))*T^3*m(m+1)(m+2)(m-1)(2m+1)(2m+3)(2m-1)/35/T^3 + 6j(5j^2 - (3m^2 + 3m - 1))*m*T^2*m(m+1)(2m+1)(2m+3)(2m-1)/15/T^2)*xj) = m(m+1)(2m+1)(2m+3)(2m-1)/105*\text{SIGMA}((6(35mj^3 + 3(m+2)(m-1)j^2 - 7m(3m^2 + 3m - 1)j - m(m+1)(m+2)(m-1))*xj) \quad \text{Equation 63}$$

The estimated value of the acceleration A is determined at the end of the series of measured values as follows.

$$A = \text{SIGMA}(6(35mj^3 + 3(m+2)(m-1)j^2 - 7m(3m^2+3m-1)j - m(m+1)(m+2)(m-1)) * xj) / (T^2 * m(m+1)(m+2)(m-1)(2m+1)(2m+3)(2m-1)/5) \quad \text{Equation 64}$$

Equation 64 is rewritten in the form of (SIGMA(wj*xj))/W as follows.

$$A = \text{SIGMA}(wAj*xj))/WA \quad \text{Equation 65}$$

where $$WA = T^2 * m(m+1)(m+2)(m-1)(2m+1)(2m+3)(2m-1)/5 \quad \text{Equation 66}$$

$$wAj = 6(35mj^3 + 3(m+2)(m-1)j^2 - 7m(3m^2+3m-1)j - m(m+1)(m+2)(m-1)) = 6(35mj^3 + 3(m+2)(m-1)j^2 - 7m(3m(m+1)-1)j - m(m+1)(m+2)(m-1)) \quad \text{Equation 67}$$

Thus, the estimated value A is expressed in the form of the sum of products as similar to equation 1. When varying m, we obtain the weighting factor wAj and normalizing constant WA tabled shown in FIG. 3.

Estimated Value of Velocity for Latest Sample (3-Degree Polynomial)

The estimated value of the velocity is expressed at the end of the series of measured values as by equation 59, and equation 59 is modified with equations 42, 45 and 48 as follows.

$$V = c + 2b*m*T + 3a(m*T)^2 = (\text{SIGMA}(wcj*xj))/Wc + 2(\text{SIGMA}(wbj*xj))/Wb*m*T + 3(\text{SIGMA}(waj*xj))/Wa*(m*T)^2 \quad \text{Equation 70}$$

Since the domain [−m, . . . , m] for SIGMA is common to the first, second and third terms, equation 70 is rewritten as $$V = \text{SIGMA}((wcj*xj)/Wc + 2(wbj*xj)/Wb*m*T + 3(waj*xj)/Wa*(m*T)^2) = \text{SIGMA}((wcj*WbWa/T^5 + 2wbj*m*WcWa/T^4 + 3waj*m^2*WcWb/T^3)*xj)/(WcWbWa/T^5) \quad \text{Equation 71}$$

Equations 43, 44, 46, 47, 49 and 50 are substituted for Wa, waj, Wb, wbj, Wc and wcj in equation 71. Following denominator and numerator are obtained.

$$\text{Denominator} = T*m(m+1)(m+2)(m-1)(2m+1)(2m+3)(2m-1)/5 * T^2*m(m+1)(2m+1)(2m+3)(2m-1)/15 * T^3*m(m+1)(m+2)(m-1)(2m+1)(2m+3)(2m-1)/35/T^5 = T*m^3(m+1)^3(m+2)^2(m-1)^2(2m+1)^3(2m+3)^3(2m-1)^3/2625 \quad \text{Equation 72}$$

$$\text{Numerator} = \text{SIGMA}((j(-7(3m^2+3m-1)j^2 + 5(3m^4+6m^3-3m+1))*T^2*m(m+1)(2m+1)(2m+3)(2m-1)/15*T^3*m(m+1)(m+2)(m-1)(2m+1)(2m+3)(2m-1)/35/T^5 + 2(3j^2 - m(m+1))*m*T*m(m+1)(m+2)(m-1)(2m+1)(2m+3)(2m-1)/5*T^3*m(m+1)(m+2)(m-1)(2m+1)(2m+3)(2m-1)/35/T^4 + 3j(5j^2 - (3m^2+3m-1))^2*T*m(m+1)(m+2)(m-1)(2m+1)(2m+3)(2m-1)/5*T^2*m(m+1)(2m+1)(2m+3)(2m-1)/15/T^3)*xj) = m^2(m+1)^2(m+2)(m-1)(2m+1)^2(2m+3)^2(2m-1)^2/525 * \text{SIGMA}(7(12m^2-3m+1)j^3 + 18m(m+2)(m-1)j^2 + (-48m^4-33m^3+21m^2-15m+5)j - 6m^2(m+1)(m+2)(m-1))*xj) \quad \text{Equation 73}$$

From equations 72 and 73, the estimated value of the velocity V is given as $$V = \text{SIGMA}(7(12m^2-3m+1)j^3 + 18m(m+2)(m-1)j^2 - (48m^4+33m^3-21m^2+15m-5)j - 6m^2(m+1)(m+2)(m-1))*xj)/(T*m(m+1)(m+2)(m-1)(2m+1)(2m+3)(2m-1)/5) \quad \text{Equation 74}$$

Equation 74 is rewritten in the form of (SIGMA(wj*xj)).

$$V = (\text{SIGMA}(wVj*xj))/WV \quad \text{Equation 75}$$

where $$WV = T*m(m+1)(m+2)(m-1)(2m+1)(2m+3)(2m-1)/5 \quad \text{Equation 76}$$

$$wVJ = 7(12m^2-3m+1)j^3 + 18m(m+2)(m-1)j^2 - (48m^4+33m^2-21m^2+15m-5)j - 6m^2(m+1)(m+2)(m-1) = 7(3m(4m-1)+1)j^3 + 18m(m+2)(m-1)j^2 - (3m(m(16m+11)-7)+5)-5)j - 6m^2(m+1)(m+2)(m-1) \quad \text{Equation 74}$$

Thus, equation 74 is modified in the form of the sum of produces similar to equation 1. When m is varied, the weighting factor wVj and normalizing constant WV are tabled in FIG. 4.

Estimated Value of Stroke for Latest Sample (3-degree Polynomial)

The estimated value of the stroke is expressed as equation 60, and equations 42, 45, 48 and 51 are substituted for the constants a, b, c and 4 in the equation 60. Then, equation 60 is written as $$X = d + c*m*T + b(m*T)^2 + a(m*T)^3 = (\mathrm{SIGMA}(wdj*xj))/Wd + (\mathrm{SIGMA}(wcj*xj))/Wc*m*T + (\mathrm{SIGMA}(wbj*xj))/\mathrm{Wb}*(m*T)^2 + (\mathrm{SIGMA}(waj*xj))/Wa*(m*T)^3 \quad \text{Equation 80}$$

Since the domain [−m, . . . , m] for SIGMA is common to the first, second and third terms, equation 80 is rewritten as $$X = \mathrm{SIGMA}((wdj*xj))/Wd + (wcj*xj)/Wc*m*T + (wbj*xj))/\mathrm{Wb}*(m*T)^2 + (waj*xj)/Wa*(m*T)^3) = \mathrm{SIGMA}((wdj*WcWbWa/T^6 + wcj*m*WdWbWa/T^5 + wbj*m^2*WdWcWa/T^4 + waj*m^3*WdWcWb/T^3)*xj)/(WdWcWbWa/T^6) \quad \text{Equation 81}$$

Equations 43, 44, 46, 47, 49, 50, 52 and 53 are substituted for Wa, waj, Wb, wbj, Wc, wcj, Wd and wdj in equation 81. Then, the following denominator and numerator are obtained.

$$\text{Denominator} = (2m+1)(2m+3)(2m-1)/3*T*m(m+1)(m+2)(m-1)(2m+1)(2m+3)(2m-1)/5*T^2*m(m+1)(2m+1)(2m+3)(2m-1)/15*T^3*m(m+1)(m+2)(m-1)(2m+1)(2m+3)(2m-1)/35/T^6 = m^3*(m+1)^3(m+2)^2(m-1)^2(2m+1)^4(2m+3)^4(2m-1)^4/7875 \quad \text{Equation 82}$$

$$\begin{aligned}\text{Numerator} = \mathrm{SIGMA}(((&-5j^2+3m^2+3m-1)*T*\\ &m(m+1)(m+2)(m-1)(2m+1)(2m+3)(2m-1)/5*T^2*\\ &m(m+1)(2m+1)(2m+3)(2m-1)/15*T^3*\\ &m(m+1)(m+2)(m-1)(2m+1)(2m+3)(2m-1)/\\ &35/T^6 + j(-7(3m^2+3m-1)j^2 +\\ &5(3m^4+6m^3-3m+1))*m*\\ &(2m+1)(2m+3)(2m-1)/3*T^2*\\ &m(m+1)(2m+1)(2m+3)(2m-1)/15*T^3*\\ &m(m+1)(m+2)(m-1)(2m+1)(2m+3)(2m-1)/\\ &35/T^5 + (3j^2-m(m+1))*m^2(2m+1)(2m+\\ &3)(2m-1)/\\ &3*T*m(m+1)(m+2)(2m+1)\\ &(m-1)(2m+3)(2m-1)/5*T^3*\\ &m(m+1)(m+2)(m-1)(2m+1)(2m+3)\\ &(2m-1)/35/T^4 + (5j^2-(3m^2+3m-1))*\\ &m^3*(2m+1)(2m+3)(2m-1)/3*T*\\ &m(m+1)(m+2)(m-1)(2m+1)(2m+3)\\ &(2m-1)/5*T^2*m(m+1)(2m+1)\\ &(2m+3)(2m-1)/15/T^3)*xj) =\\ &m^3(m+1)^2(m+2)(m-1)^2(2m+1)^3(2m+3)^3\\ &(2m-1)^4/7875*\ \mathrm{SIGMA}(35j^3+15(m+2)j^2-\\ &5(3m^2-5)j-3(m+1)(m+2)(m-1))*xj)\end{aligned} \quad \text{Equation 83}$$

From equations 82 and 83, the estimated value X of the stroke is given at the end of the series of measured values as follows.

$$X = \mathrm{SIGMA}((35j^3+15(m+2)j^2-5(3m^2-5)j-3(m+1)(m+2)(m-1))*xj)/((m+1)(m+2)(2m+1)(2m+3)) \quad \text{Equation 84}$$

Equation 84 is rewritten in the form of (SMGMA(wj*xj))/W).

$$X = (\mathrm{SIGMA}(wXj*xj))/WX \quad \text{Equation 85}$$

where $$WX = (m+1)(m+2)(2m+1)(2m+3) \quad \text{Equation 86}$$

$$wXj = 35j^3+15(m+2)j^2-5(3m^2-5)j-3(m+1)(m+2)(m-1) \quad \text{Equation 87}$$

Thus, the estimated value of the stroke X is expressed in the form of a sum of produces as similar to equation 1. When varying m, we determine the weighting factor wXj and normalizing constant WX as shown in FIG. 5.

As will be understood from the above-described mathematical analysis, it is possible to determine the estimated values of the stroke, estimated values of the velocity and estimated values of the acceleration at the end of a series of measured values or samples on the approximation to either second degree polynomial or third degree polynomial. If the weighting factors and normalizing constant have been already known, the estimated values are immediately determined at the end of the series of measured values on the basis of the weighting factors and normalizing constant. For this reason, the weighting factors and normalizing constants are tabled in a suitable memory in an embodiment, which will be described hereinafter in detail.

DESCRIPTION OF THE PREFERRED EMBODIMENTS

First Embodiment

In the following description, term "front" is indicative of a position closer to a human player, who is playing a piece of music, than a position modified with term "rear". A line, which passes through a front position and a corresponding rear position, extends in a "fore-and-aft direction", and a line, which crosses the line at right angle, extends in a "lateral direction".

Referring to FIG. 6 of the drawings, an automatic player piano embodying the present invention largely comprises an acoustic piano 1 and an electronic system 100. The electronic system 100 is installed inside the acoustic piano, and cooperates therewith for producing piano tones without any fingering of a human player. A user records a performance on the acoustic piano 1 through the electronic system 100, and reproduces the performance or another performance also through the electronic system 100. Thus, at least the recording mode and playback mode are selectively established in the automatic player piano.

Acoustic Piano

In this instance, a standard grand piano is used as the acoustic piano 1. Of course, an upright piano is available for the automatic player piano. The acoustic piano 1 includes a keyboard 1*a*, action units 1*b*, hammers 2, strings 4 and dampers 6. Although the acoustic piano 1 further includes a pedal system, the pedal system is well known to persons skilled in the art, and is not described hereinafter.

A human player designates the acoustic piano tones to be produced by fingering on the keyboard 1*a*, and selectively gives rise to the motion of the action units 1*b* through the keyboard 1*a*. The action units 1*b* causes the associated dampers 6 to be spaced from the associated strings 4 so that the associated strings 4 get ready to vibrate. The action units 1*b* further make the associated hammers 2 escaped therefrom. Then, the hammers 2 are driven for rotation toward the strings 4. When the hammers 2 are brought into collision with the associated strings 4, the hammers 2 give rise to vibrations of the associated strings 4, and the acoustic tones are generated from the vibrating strings 4.

The keyboard 1*a* is mounted on a key bed 1*c*. Plural black keys 70 and plural white keys 70 are incorporated in the keyboard 1*a*, and are lain on the well-known pattern. The black/white keys 70 are coupled to a balance rail 71 by means of balance pins 80, and are rotatable about the balance rail 71. While the black/white keys 70 are free from any force, the front portions of the black/white keys 70 are staying at rest positions indicated by real lines. When force is exerted on the front portions, the front portions start to sink from the rest positions toward end positions indicated by dot-and-dash lines. The black/white keys 70 are respectively associated with the action units 1*b*, which in tern are respectively associated with the hammers 2. The hammers 2 are respectively associated with the strings 4, and the strings 4 are respectively associated with the dampers 6.

The black/white keys 70 are respectively linked with the dampers 6 at the rearmost ends thereof, and are further linked with the action units 1*b* at rear portions thereof, respectively. While the black/white keys 70 are resting, the dampers 6 are held in contact with the associated strings 4, and prevent the strings 4 from unintentional vibrations. The black/white keys 70 upwardly push the dampers 6 on the way to the end positions so that the dampers 6 are spaced from the associated strings 4 before the strings 4 are struck with the hammers 2.

Although the action units 1*b* are more complicated than other component parts of the acoustic piano 1, the structure and motion of the action units 1*b* are well known to the skilled persons so that no further description is incorporated hereinbelow for the sake of simplicity.

Assuming now that a pianist depresses one of the black/white keys 70, the front portion of the black/white key 70 starts to sink toward the end position. The depressed black/white key 70 spaces the damper 6 from the associated string 4 on the way to the end position so that the string 4 gets ready for vibration. The depressed black/white key 70 further gives rise to the rotation of the associated action unit 1*b*. While the depressed black/white key 70 is forcing the associated action unit 1*b* to rotate, the action unit 1*b* also forces the associated damper 2 to rotate so that the hammer 2 slowly advances to the associated string 4.

When the action unit 1*b* escapes from the associated hammer 2, the hammer 2 is driven for the rotation, and rushes toward the string 4. The string 4 is brought into collision with the string 4, and gives rise to the vibrations for the acoustic piano tone.

The hammer 2 rebounds on the string 4, and is fallen onto the action unit 1*b*. When the pianist releases the depressed black/white key 70, the black/white key 70 returns to the rest position together with the action unit 1*b*, and permits the damper 6 to be brought into contact with the string 4, again. Then, the vibrations are taken up by the damper 6, and the acoustic piano tone is decayed. As will be understood, the acoustic piano 1 behaves as similar to a standard grand piano.

Electronic System

The electronic system 100 includes a controller 102, an array of solenoid-operated key actuators 104, an array of key sensors 106 and an array of hammer sensors 108. The controller 102 has a data processing capability, and selectively runs on computer programs in at least a recording mode and a playback mode. The controller 102 has a signal input port, to which the key sensors 106 and hammer sensors 108 are connected. The controller 102 further has a signal input and output port, which is connected to the solenoid-operated key actuators 104. Though not shown in FIG. 6, the controller 102 is connected to a suitable data storage such as, for example, a flexible disk, and music data codes are output to and input from the data storage.

The solenoid-operated key actuators 104 have respective solenoids 25 and respective plungers 15, and the plungers 15 are projectable from and retractable into the associated solenoids 25. A slot 1*d* is formed in the key bed 1*c* under the rear portions of the black/white keys 70, and the solenoids 25 are secured to the key bed 1*c* in such a manner that the plungers 15 project over the upper surface of the key bed 1*c*. Built-in plunger sensors 10 are incorporated in the solenoid-operated key actuators 104, respectively, and monitor the associated plungers 15 for producing plunger position signals representative of current plunger positions.

When a driving signal is supplied from the controller 102 to the solenoid-operated key actuators 104, the solenoids 25 are energized, and magnetic field is created around the plungers 15. Then, the plungers 15 start to move upwardly, and push the rear end portions of the associated black/white keys 70. The built-in plunger sensors 10 vary the plunger position signals depending upon the current plunger positions of the associated plungers 15, and the plunger position signals are fed back to the controller 102. The controller 102 compares the current plunger positions with target positions on reference trajectories to see whether or not the plungers 15 travel on the reference trajectories. If the answer is given affirmative, the controller 102 keeps the driving signal unchanged. On the other hand when the controller 102 finds the plungers 15 to be in advance or delayed, the controller 102 accelerates or decelerates the plungers 15 through the driving signals. Thus, the solenoid-operated key actuators 104 with built-in plunger sensors 10 and controller 102 form in combination feedback loops so as to exactly control the key motion of the associated black/white keys 70.

The array of key sensors 106 is provided under the black/white keys 70. Each of the key sensors 106 is broken down into photo-couplers 27 and an optical modulator 75. The optical modulator 75 is secured to the lower surface of the associated black/white key 70, and the photo-coupler 27 is stationary on the key bed 1*c*. While the black/white key 70 is moving between the rest position and the end position, the optical modulator 75 varies the amount of light measured by the photo-couplers 27, and the current key position is converted to the key position signal. The key position signal is supplied to the controller 102, and the key motion is analyzed on the basis of a series of current key positions. The controller 102 determines a key-on timing, a key-off timing, a key-on velocity and a key-off velocity through the analysis.

The array of hammer sensors 108 is provided over the hammers 2. Each of the hammer sensors 108 is also broken down into photo couplers 22 and an optical modulator 26. The optical modulator 26 is secured to the associated hammer 2, and a bracket 1*f* keeps the photo couplers 22 stationary over the associated hammer 2. While the hammer 2 is rotating toward the associated string 4, the optical modulator 26 is moved across the light beams of the photo couplers 22, and the photo couplers 22 vary the hammer position signal depending upon the current hammer position. The hammer position signal is supplied to the controller 102, and the controller 102 determines a hammer velocity and timing at which the string 4 is struck with the hammer 2.

Figure 7:
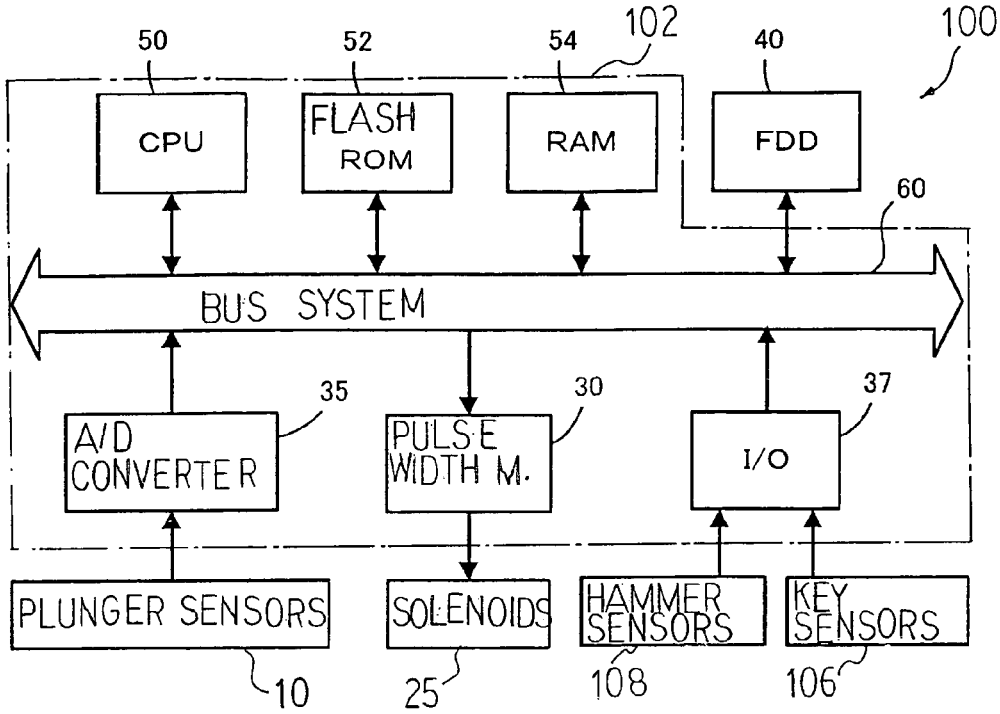
FIG. 7 is a block diagram showing the system configuration of a controller incorporated in an electronic system of the automatic player piano.

Turning to FIG. 7 of the drawings, the controller 102 includes a central processing unit 50, which is abbreviated as "CPU", a flash read only memory 52, which is abbreviated as "FLASH ROM", a random access memory 54, which is abbreviated as "RAM", an analog-to-digital converter 35, a pulse width modulator 30, an input-and-output port 37 and a shared bus system 60. The component parts 50, 52, 54, 35, 30 and 37 are connected to the shared bus system 60. The shared bus system 60 is selectively occupied by the component parts 50/52/54/35/30/37, and address codes, data codes and instruction codes are selectively transferred between two component parts through the shared bus system 60.

The computer programs, tables shown in FIGS. 1 to 5 and other parameters are stored in the flash read only memory 52, and the random access memory 54 serve as a working memory for the central processing unit 50. The central processing unit 50 sequentially fetches the instruction codes, which form the computer programs, from the flash read only memory 52, and accomplishes tasks selectively assigned to a preliminary processing section 110, a motion controlling section 120, a recording section 130 and a post processing section 150 (see FIG. 6). The tasks will be hereinlater described in detail.

A flexible disk driver unit 40 is further connected to the shared bus system 60, and the music data codes are stored into and read out from a flexible disk through the flexible disk driver unit 40.

The built-in plunger sensors 10 are connected to the analog-to-digital converter 35, and the current plunger position is converted to a digital plunger position signal. The central processing unit 50 fetches the digital plunger position signal from the analog-to-digital converter 35, and compares the current plunger position, which is equivalent to the current position of the associated black/white key 70, with the target plunger position on the reference trajectory to see whether or not the black/white key 70 is exactly moved on the reference trajectory.

The pulse width modulator 30 is connected to the solenoids 25. The pulse width modulator 30 is responsive to a control data code supplied from the central processing unit 50 so as to vary the duty ratio of the driving signal. When the central processing unit 50 notices the plunger 10, i.e., black/white key 70 advance or retard, the central processing unit 50 supplies the control data code representative of the increment or decrement of the duty ratio to the pulse width modulator 30, and the pulse width modulator 30 varies the duty ratio of the driving signal. The driving signal is supplied to the solenoid 25. Since the strength of magnetic field is proportional to the mean current supplied to the solenoids 25, the magnetic force exerted on the plungers 15 is changed depending upon the duty ratio. This results in the acceleration or deceleration of the plunger 15.

The input-and-output port 37 is connected to the hammer sensors 20 and key sensors 27, and the key position signal and hammer position signal are reshaped there. The central processing unit 50 periodically reads out the current hammer positions and current key positions from the input-and-output port 37, and the current hammer positions and current key positions are temporarily stored in the random access memory 54 for the analysis.

The number of the solenoids 25, the number of the hammer sensors 108, the number of the built-in plunger sensors 10, the number of the key sensors 106 and the number of the data input circuits, which are incorporated in the input-and-output port 37, are equal to the number of the black/white keys 70.

Turning back to FIG. 6, while the central processing unit 50 is running on the computer program in the playback mode, the controller 102 accomplishes the task assigned to the preliminary processing section 110 and the task assigned to the motion controlling section 120. The music data codes are supplied from the flexible disk through the flexible disk driver 40 to the controller 102. The music data codes may be supplied from a data source through a communication network to the controller 102.

In detail, the music data codes, which represent a note-on event, i.e., the generation of an acoustic piano tone, are assumed to reach the controller 102. The music data codes are transferred to the preliminary processing section 110, and the preliminary processing section 110 analyzes the music data codes so as to determine the reference trajectory for each of the black/white keys to be moved. The method for determining the reference trajectory is disclosed in Japanese Patent Application laid-open No. Hei 7-175472. Data codes, which represent the reference trajectory, are supplied from the preliminary processing section 110 to the motion controlling section 120. The reference trajectory is expressed as a series of target values of the stroke of the key in terms of time. The target values of the key velocity are also calculated at the target values of the stroke. The preliminary processing section 110 informs the motion controlling section 120 of the reference trajectories in the form of control data.

The motion controlling section 120 determines the duty ratio of the driving signal on the basis of the target stroke, and adjusts the driving signal to the value of the duty ratio. The driving signal is supplied from the motion controlling section 120 to the solenoid-operated key actuator 104 under the black/white key 70 to be moved. The current flows through the solenoid 25, and the magnetic force is exerted on the plunger 15. The plunger 15 starts to project from the solenoid 25, and the plunger sensor 10 supplies the plunger position signal, which is representative of the current plunger position, to the motion controlling section 120.

As described hereinbefore, the noise is unavoidably introduced into the current plunger position, and, accordingly, the plunger position signal contains the corresponding noise component. If the motion controlling section 120 interprets the current plunger position as the current key position or the actual stroke of the key, the noise will have a serious influence on the servo-control. In order to eliminate the noise from the actual stroke, the motion controlling section 120 calculates the estimated value of the stroke and the estimated value of the velocity, and varies the duty ratio of the driving signal on the basis of the difference between the estimated values and the target values. As a result, the black/white key 70 travels on the reference trajectory. The restriction of the noise will be hereinafter described in detail.

When the plunger position signal reaches the motion controlling section 120, the motion controlling section 120 determines the estimated value of the stroke and the estimated value of the velocity, and compares the estimated values with the corresponding target values to see whether or not the black/white key 70 travels on the reference trajectory. If the difference is ignoreable, the motion controlling section 120 keeps the driving signal at the calculated duty ratio. However, when the motion controlling section 120 notices the difference serious, the motion controlling section 120 varies the duty ratio, and accelerates or decelerates the plunger 15. The plunger 15 pushes the rear portion of the black/white key 70 upwardly so that the damper 6 is spaced from the associated string 4. The black/white key 70 causes the associated action unit 1*b* to escape from the hammer 2 so that the hammer 2 is driven for rotation toward the string 4. The string 4 has already gotten ready to vibrate. When the hammer is brought into collision with the string 4, the string 4 starts to vibrate, and the acoustic piano tone is radiated from the vibrating string 4.

The loudness of the acoustic piano tone is proportional to the final velocity of the hammer. As described hereinbefore, the black/white key 70 is forced to travel on the reference trajectory so as to impart the final velocity, which is equal to that in the original performance, to the hammer 2. This results in the loudness equal to that in the original performance. The preliminary processing section 110 and motion controlling section 120 sequentially give rise to the key motion same as that in the original performance so that the original performance is exactly reproduced in the playback mode.

On the other hand, while the central processing unit 50 is running on the computer program in the recording mode, the controller 102 accomplishes the tasks of the recording section 130 and the tasks of the post processing section 150.

The hammer sensors 108 and key sensors 106 monitor the hammer motion and key motion, respectively, and supply the hammer position signals and key position signals to the recording section 130. The central processing unit 50 periodically fetches the hammer position signals and key position signals at the input-and-output ports 37, and memorizes the current hammer positions and current key positions in the random access memory 54. The central processing unit 50 determines the depressed keys 70, the key-on timing, key-on velocity, released keys 70, key-off velocity and key-off timing on the basis of the current key positions memorized in the random access memory 54. Similarly, the central processing unit 50 determines the final hammer velocity and timing at which the strings 4 are struck with the hammers 2 on the basis of the current plunger positions memorized in the random access memory 54. The recording section 130 gathers pieces of music data information, i.e., the key codes assigned to the depressed keys 70, key-on timing, key-on velocity, key codes assigned to the released keys 70, key-off timing, key-off velocity, final hammer velocity and timing at which the strings 4 are struck, and encodes the key codes assigned to the depressed keys 70, key-on timing, timing at which the strings 4 are struck, key-on velocity, final hammer velocity and the key codes assigned to the released keys 70, key-off timing and key-off velocity into music data codes representative of note-on events and music data codes representative of note-off events. Thus, the recording section 130 produces the music data codes representative of the original performance.

The music data codes are further examined by the post processing section 150. The post processing section 150 completes the set of music data codes. For example, a pianist is assumed to repeatedly depress a black/white key 70 without allowing the black/white key to return to the end position. Even though the complicated key motion results in the acoustic piano tones repeated certain times, the recording section may miss a note-on event. In order to find the missing note-on event, the post processing section 150 analyzes the series of key positions representative of the complicated key motion, and supplements the music data codes representative of the missing note-on event into the set of music data codes. Upon completion of the data processing by the post processing section 150, the set of music data codes is transferred to the flexible disk driver 40, and are written in a flexible disk. Otherwise, the music data codes are transferred through the communication network to another musical instrument in a real time fashion.

Servo-Control

Figure 8:
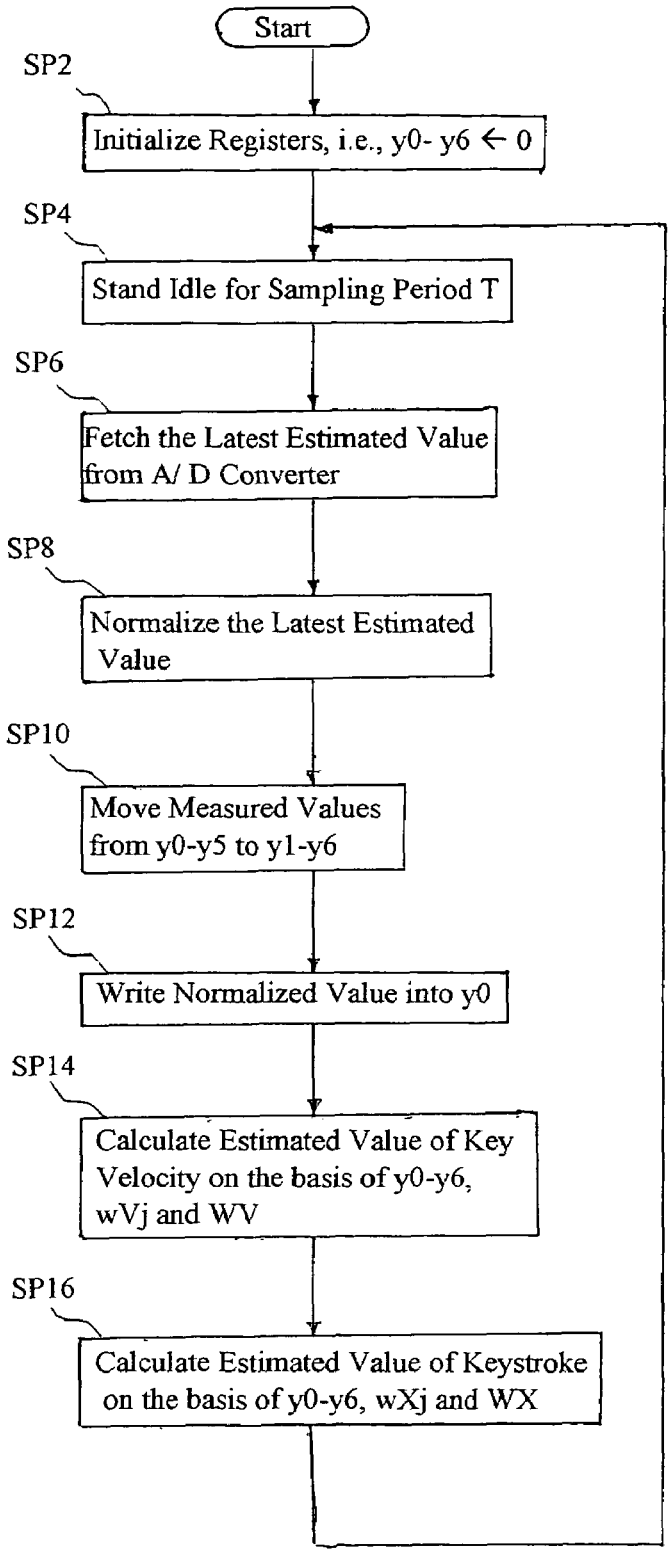
FIG. 8 is a flowchart showing a method for estimating a true stroke of keys.

FIG. 8 shows a method for determining the estimated values of the stroke and the estimated values of the velocity on the basis of the measured values of the current plunger position, i.e., the stroke of the black/white keys 70. The estimation is one of the tasks to be accomplished by the motion controlling section 120, and the method is realized through the execution of the computer program.

The controller 102 is assumed to be powered. The central processing unit 50 starts to run on the computer program, and initializes or resets registers y0-y6 to zero, which are assigned to the measured values of the actual stroke of the black/white keys 70, as by step SP2. The registers y0-y6 are prepared in the random access memory 54.

Upon completion of the initialization, the central processing unit 50 enters a loop consisting of steps SP4 to SP16, and reiterates the loop until the power is removed from the central processing unit 50. The central processing unit 50 stands idle for the sampling time period T as by step SP4.

When the sampling time period T is expired, the A/D converter 35 completes the analog-to-digital conversion, and the central processing unit 50 fetches the latest measured value from the analog-to-digital converter 35 as by step SP6. The central processing unit 50 temporarily stores the latest measured value in an internal register, and normalizes the latest measured value so as to eliminate the individualities of the built-in plunger sensor 10 from the latest measured value as by step SP8.

Subsequently, the measured values, which have been already stored in the registers y0-y5, are moved to the registers y1-y6 as by step SP10. This means that the register y0 gets ready to memorize a new measured value. Then, the central processing unit 50 memorizes the latest measured value, which was normalized at step SP8, into the register y0 as by step SP12. Thus, the latest seven measured values have been memorized in the registers y0-y6.

Subsequently, the central processing unit 50 accesses the table shown in FIG. 1, by way of example, and reads out the weighting factors wVj and normalizing constant WV from the table. As described hereinbefore, the seven registers y0-y6 have been prepared for the latest measured values. The number of the measured value is seven, i.e., m=3 and n=7. Then, the normalizing constant WV is 28, and the weighting factors wXj for the seven latest measured values are [5, −3, −6, −4, 3, 15, 32]. The central processing unit 50 multiplies the seven latest measured values by the weighting factors [5, −3, −6, −4, 3, 15, 32], respectively, and accumulates the produces. Finally, the central processing unit 50 divides the sum of the products by the normalizing constant WV, i.e., 28. The estimated value V of the key velocity is given as the quotient. Thus, the central processing unit 50 determines the estimated value V of the key velocity as by step SP14.

Subsequently, the central processing unit 50 accesses the table shown in FIG. 2, by way of example, and reads out the weighting factors wXj and normalization constant WX. Since m=3 and n=7, the normalizing constant WX is 42, and the weighting factors wXj are [5, −3, −6, −4, 3, 15, 32]. The central processing unit 50 multiplies the measured values, which are respectively memorized in the registers y6, y5, y4, y3, y2, y1, y0, by the weighting factors [5, −3, −6, −4, 3, 15, 32], and determines the sum of the products. The central processing unit 50 divides the sum of the products by the normalizing constant WX, and the estimated value X of the keystroke is given as the quotient. Thus, the central processing unit 50 determines the estimated value X of the keystroke as by step SP16.

The central processing unit 50 compares the estimated values V and X with the target values to see whether or not the black/white key 70 is traveling on the reference trajectory. If the central processing unit 50 notices the black/white key 70 deviated from the reference trajectory, the central processing unit 50 varies the duty ratio so as to accelerate or decelerate the black/white key 70. When the central processing unit 50 confirms that the black/white key 70 travels on the reference trajectory, the central processing unit 50 keeps the driving signal at the previous duty ratio. Thus, the central process-ing unit 50 forces the black/white key 70 to travel on the reference trajectory through the servo-control.

Upon completion of the regulation of the driving signal, the central processing unit 50 returns to step SP4. The latest measured value xj is shifted from the register y3 to the register y2, and the measured value x2 is shifted from the register y2 to y1. The measured value in the register y-3 is discarded. Thus, the measured values are rippled, and the latest measured value is newly stored in the register y3. Thus, the central processing unit 50 repeats the loop consisting of steps SP4 to SP16 for the servo-control at intervals equal to the sampling time period T.

Figure 9:
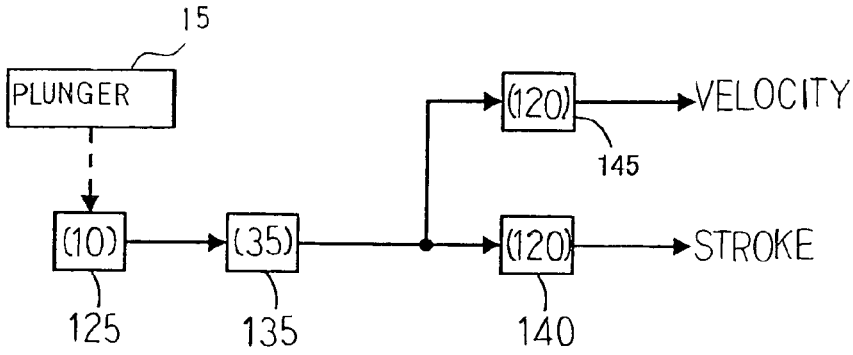
FIG. 9 is a block diagram showing an algorithm employed in a motion controlling section of the controller.

FIG. 9 shows the algorithm employed in the motion controlling section 120. The built-in plunger sensors 10 monitor the plungers 15, respectively, and the current plunger position or plunger stroke is determined through the function 125 of the built-in plunger sensors 10. The plunger position signal representative of the current plunger position or plunger stroke is supplied to the analog-to-digital converter 35. The plunger position signal is sampled in the analog-to-digital converter 35, and the discrete value is converted to a binary value through the analog-to-digital conversion 135. Thus, the measured values of the plunger stroke are obtained through the analog-to-digital conversion.

Since the plungers 15 are moved together with the black/white keys 70, the plunger stroke are assumed to be equal to the keystroke. For this reason, the latest measured value is memorized in the register y0 as the measured value of the actual stroke at j=3. Since the plunger 15 does not start to project at t=0, zero is memorized in the register at j=3.

The weighting factors wXj and normalizing constant WX are read out from the table stored in the flash read only memory 52. The measured values at j=−3, −2, −1, 0, 1, 2, 3 are multiplied with the weighting factors such as wXj=5, −3, −6, −4, 3, 15, 32, and the sum of products is divided by the normalizing constant WX as expressed by equation 35, i.e., X=(SIGMA (wXj*xj))/WX. The estimated value X is corresponding to the latest measured value or the end of the series of the measured values. In the above-described embodiment, the estimated value X occupies the position at j=3. Thus, the stroke of the black/white key 70 is estimated through the function 140 of the motion controlling section 120.

Similarly, the weighting factors wVj and normalizing constant WV are read out from the table also stored in the flash read only memory 52. The measured values at j=−3, −2, −1, 0, 1, 2, 3 are respectively multiplied by the weighting factors such as wVj=7, −2, −7, −8, −5, 2, 13, and the sum of products is divided by the normalizing constant WV as expressed by equation 25, i.e., V=(SIGMA(wVj*xj))/WV. The estimated value V is corresponding to the latest measured value or the end of the series of the measured values. In the above-described embodiment, the estimated value V occupies the position at j=3. Thus, the key velocity is estimated through the function 145 of the motion controlling section 120.

As will be understood from the foregoing description, even though the measured values of the keystroke contains error, the controller 102 estimates the actual keystroke through the sum of products between the measured values and the weighting factors, and controls the driving signal in such a manner as to force the black/white keys to travel on the reference trajectories. The black/white keys 70 thus forced to travel on the reference trajectories make the associated hammers brought into collision with the strings at the final hammer velocity approximately equal to the final hammer velocity in the original performance. This results in the acoustic piano tones equal in loudness to those produced in the original performance. Thus, the automatic player piano according to the present invention exactly reproduces the acoustic piano tones.

The controller 102 directly estimates the latest estimated value of the actual stroke and latest estimated value of the actual key velocity through the simple arithmetic, i.e., the division of the sum-products between the measured values and the weighting factors by the normalizing constant. In case where the estimated value is given only at the center of the series of measured value, the controller needs to further calculate the latest estimated value or the estimated value at the end of the series by multiplying the center estimated value by (differentiation * m * sampling period). Thus, the method according to the present invention is simple, and the estimated value is smoothly used in the feedback control.

Second Embodiment

Figure 10:
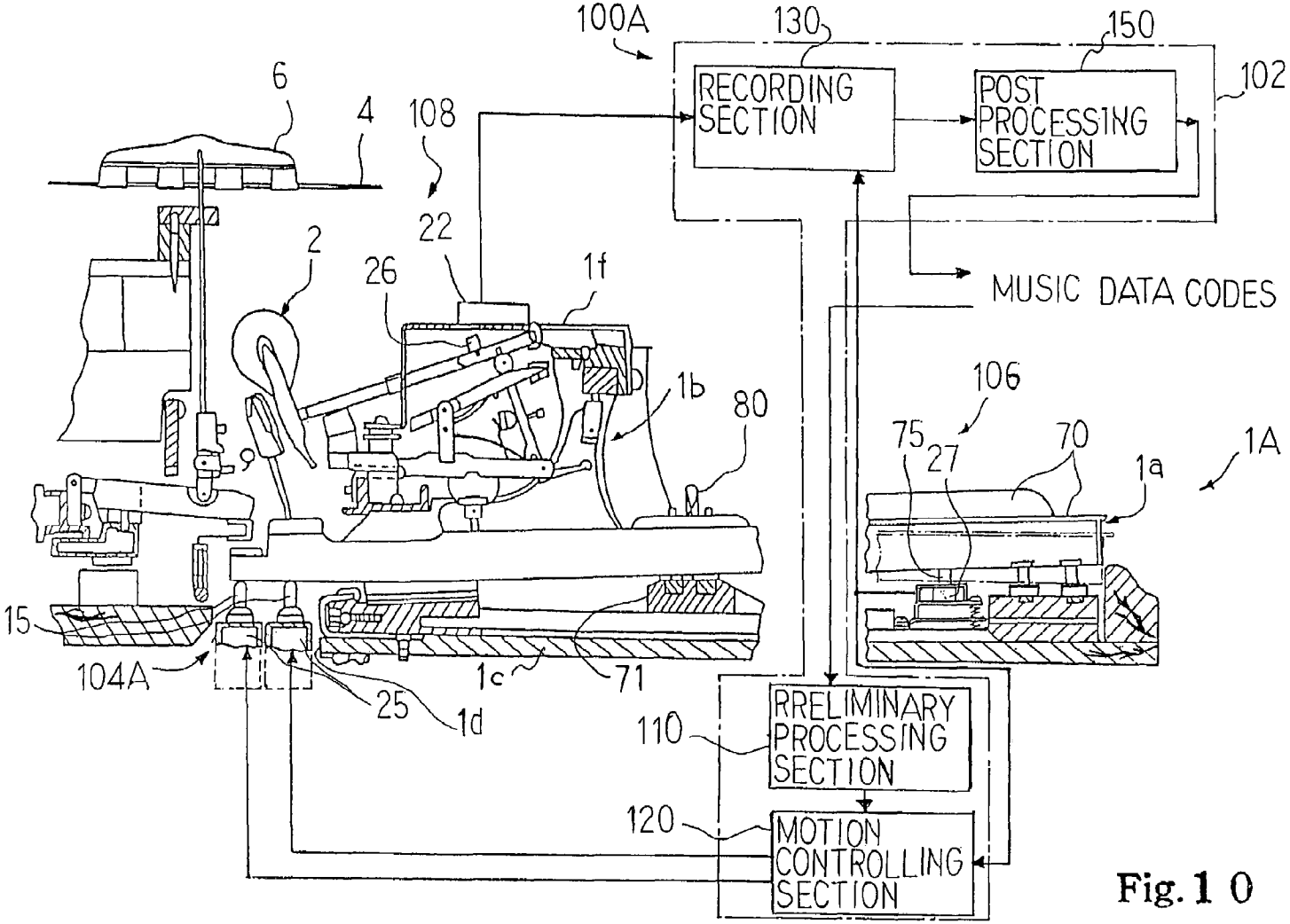
FIG. 10 is a cross-sectional side view showing the structure of another automatic player piano according to the present invention.

Turning to FIG. 10 of the drawings, another automatic player piano embodying the present invention also largely comprises an acoustic piano 1A and an electronic system 100A. The acoustic piano 1A is similar in structure to the acoustic piano 1 so that description on the acoustic piano 1A is omitted from the following description for the sake of simplicity.

The electronic system 100A is similar to the electronic system 100 except for solenoid-operated key actuators 104A. The solenoid-operated key actuators 104A are different from the solenoid-operated key actuators 104 in that any plunger sensors are not incorporated therein. In order to determine the actual key stroke in the playback mode, the key sensors 106 are connected to both recording and motion controlling sections 130/120. While the automatic player piano is working in the recording mode, the key position signals are supplied from the key sensors 106 to the recording section 130, and the pieces of data information are processed by the recording section 130. On the other hand, while the automatic player piano is reproducing a performance, the key position signals are supplied from the key sensors 106 to the motion controlling section 120, and the motion controlling section 120 periodically samples the measured value of the actuator key stroke from the key position signals.

The method employed in the motion controlling section 120 is similar to that employed in the motion controlling section 120 of the first embodiment, and no further description is incorporated hereinafter for avoiding repetition.

The automatic player piano implementing the second embodiment achieves all the advantages of the first embodiment. Moreover, the automatic player piano of the second embodiment is preferable to that of the first embodiment, because the standard solenoid-operated key actuators 104A are economical.

Third Embodiment

Figure 11:
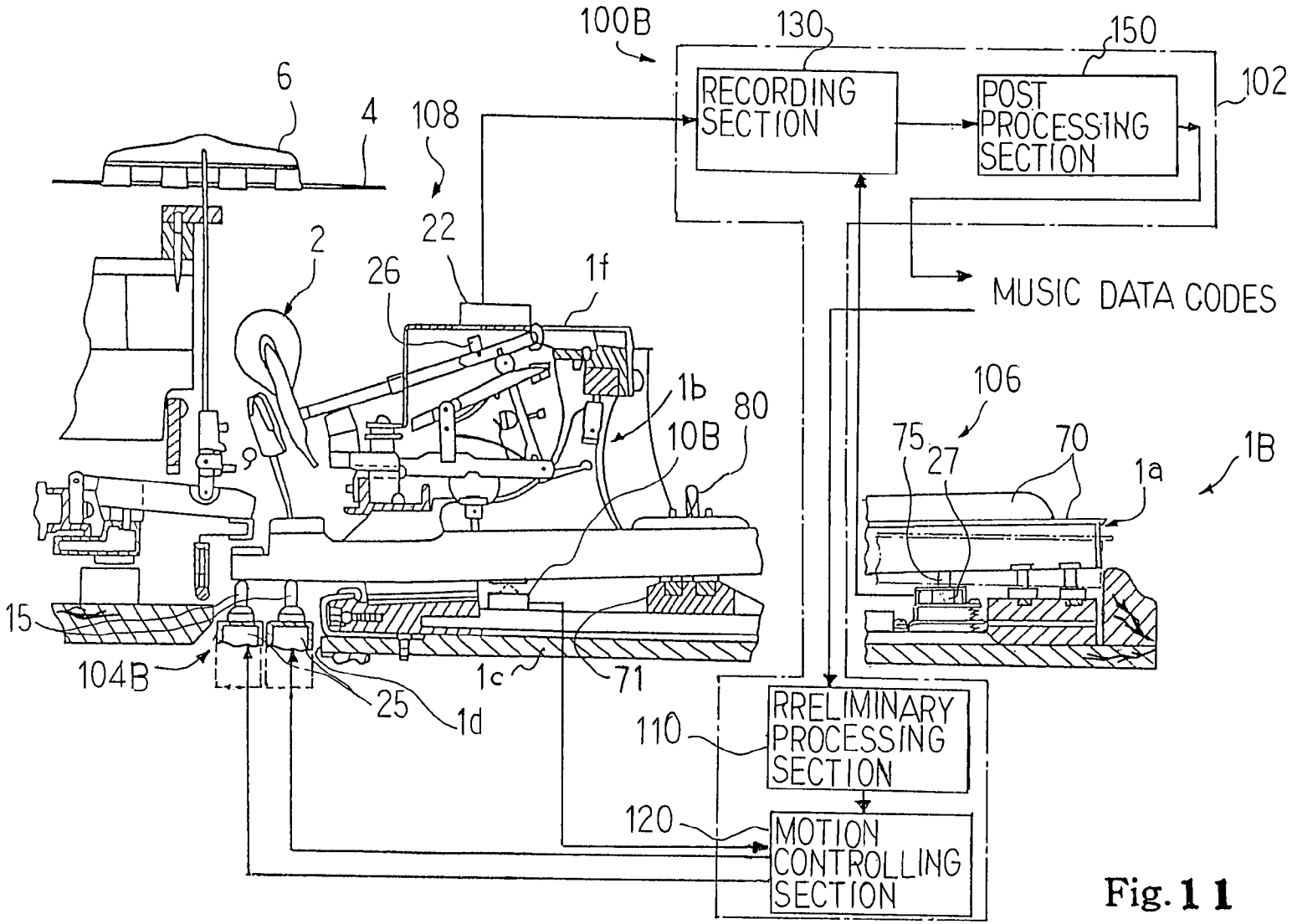
FIG. 11 is a cross-sectional side view showing the structure of yet another automatic player piano according to the present invention.

Turning to FIG. 11 of the drawings, yet another automatic player piano embodying the present invention largely comprises an acoustic piano 1B and an electronic system 100B. The acoustic piano 1B is similar in structure to the acoustic piano 1 so that the acoustic piano 1B is not hereinafter detailed for the sake of simplicity.

The electronic system 100B is similar to the electronic system 100 except for solenoid-operated key actuators 104B. The solenoid-operated key actuators 104B are same as the solenoid-operated key actuators 104A, and any plunger sensors are not incorporated therein. Instead, reflection type key sensors 10B are provided under the rear portions of the black/white keys 70. The reflection type key sensors 10B produce key position signals representative of the actual keystroke, and supplies the key position signals to the motion controller 120. The motion controller 120 periodically samples discrete values, and measured values are processed as similar to those of the first embodiment.

The automatic player piano implementing the third embodiment achieves all the advantages of the first embodiment.

Evaluation

Figure 12:
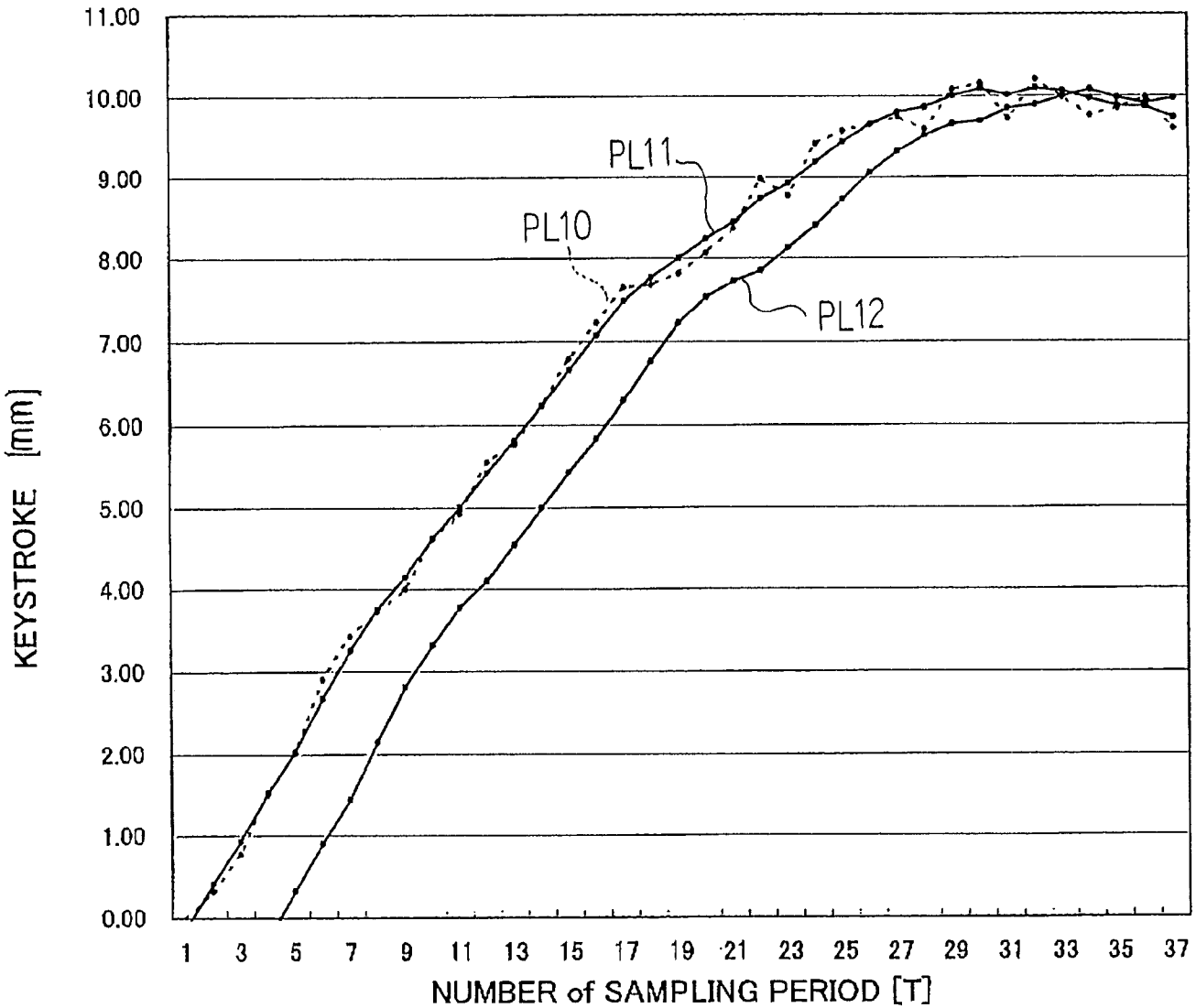
FIG. 12 is a graph showing a result of an experiment carried out for evaluation of the present invention.

The present inventor evaluated the approximation of the present invention. FIG. 12 shows the result of an experience carried out in the evaluation. The axis of coordinates is indicative of the keystroke, over which the black/white key traveled, and the abscissa is indicative of the number of sampling periods. The present inventor plotted measured values of the keystroke PL10. The present inventor approximated every 23 measured values to the 2-degree polynomial according to the present invention, and determined the estimated values as described hereinbefore in detail. Plots PL11 stands for the estimated values obtained through the approximation of the present invention.

The present inventor further determined the estimated values by using the prior art error suppressing technique disclosed in "Processing on Waveform Data for Scientific Measurement". Each estimated value was based on seven measured values. Plots PL12 stands for the estimated values obtained through the prior art technique.

Comparing plots 12 with plots 11, it is understood that the estimated values PL11 were closer to the plots PL10 than the estimated values PL12. In fact, the prior art estimated values were delayed from the corresponding measured values by at least 3 sampling periods. On the other hand, although the measured values processed through the approximation of the present invention was much greater than those processed through the prior art, the time lag of the estimated values of the present invention was negligible. Thus, the approximation technique according to the present invention was enhanced in promptness. In other words, the approximation technique of the present invention was more valuable than the prior art technique.

Usage in Recording Mode

While a user is performing a piece of music on the automatic player piano, the post processing section 150 may determine the estimated values through the approximation of the present invention, and transfers the estimated values to a suitable data storage for recording the performance. As described hereinbefore, the estimated values are close to the target values so that the original performance is exactly reproduced on the basis of the music data codes produced from the estimated values.

Although particular embodiments of the present invention have been shown and described, it will be apparent to those skilled in the art that various changes and modifications may be made without departing from the spirit and scope of the present invention.

The automatic player piano may further include a mute system. A hammer stopper and an electronic tone generating system are incorporated in the mute system. The hammer stopper is changed between a free position and a blocking position. While a user is playing a piece of music in the free position, the hammer stopper keeps itself out of the trajectories of the hammers, and permits the strings to be struck with the hammers. On the other hand, when the user changes the hammer stopper to the blocking position, the hammer stopper is moved into the trajectories of the hammers. While the user is fingering a piece of music, the hammers are escaped from the associated action units in the similar manner. However, the hammers rebound on the hammer stopper before reaching the strings. Thus, any acoustic piano tone is not produced from the strings. Instead, electronic piano tones are produced through the electronic tone generating system. The user may hear the electronic piano tones through a headphone.

The motion controlling section may process pedal position signals representative of current pedal positions of pedals incorporated in the automatic player piano.

The motion controlling section may further process hammer position signals representative of current hammer positions. As described in conjunction with the evaluation, the approximation technique according to the present invention is enhanced in promptness of the automatic playing system. This means that the approximation technique makes it possible promptly to reproduce the motion of any sort of component parts such as hammers.

The keyboard musical instrument, an example of which is the automatic player piano, does not set any limit to the technical scope of the present invention. The present invention is applicable to another sort of electronic musical instrument, industrial machinery and robots.

The solenoid-operated key actuators may be replaced with pneumatic actuators or hydraulic actuators. In these systems, a motion controlling section supplies the air or pressurized fluid to the pneumatic actuators or hydraulic actuators.

The plunger sensors 10, key sensors 106 and key sensors 10B, which serve as the position transducers, do not set any limit to the technical scope of the present invention. Key sensors may measure the key velocity or acceleration. In this instance, the stroke is calculated through the integration.

The division of the sum of products by the normalizing factor does not set any limit to the technical scope of the present invention. The quotient of the division between the measured values and the normalizing constant may be multiplied by the weighting factors, and the product is accumulated for the estimated values. Otherwise, the weighting factors may be divided by the normalizing constant, and the quotient is tabled in the flash memory. In this instance, the estimated values are directly given as the sum of products.

The normalizing constant does not set any limit to the technical scope of the present invention. The estimated values of the actual stroke and estimated values of the key velocity may be given as the sum of products between the measured values and the weighting factors. Although the sum of products are a multiple of the estimated value, it is possible to control the black/white key 70 by using the sum of products.

The 2-degree polynomial and 3-degree polynomial are given as the examples of the polynomial. More than 2-degree polynomial may be used in the polynomial approximation for the series of measured values.

The computer program, which expresses the method according to the present invention, may be supplied from another sort of data storage. In case where the controller 102 is implemented by a personal computer system, the computer program is prepared as an application program.

The computer program, which expresses the method according to the present invention, may be distributed through a flexible disk or a compact disk. Otherwise, the computer program may be downloaded through a communication network.

The registers y0-y6 defined in the random access memory do not set any limit to the technical scope of the present invention. A shift register or a ring buffer may be incorporated in the electronic system so as to rewritably store the measured values.

The registers y0-y6 may be initialized to a value depending upon the motion of the system.

An even number of measured values may be examined for the estimated value. The sampling intervals may be irregular. Even so, it is possible to determine the estimated values by using appropriate weighting factors and appropriate normalizing constant.

The motion controlling section 120 may not normalize the latest estimated value as by step SP8. The normalization is required for the latest estimated values supplied from musical instruments different from one another. If the motion controlling section 120 is expected to process the measured values supplied from only one musical instrument, the motion controlling section 120 may skip the step SP8. However, a calibration may be required.

The weighting factors may be determined as follows.

(1) In case where (2m+1) measured values in [−m, . . . , 0, . . . +m] are approximated as a 2-degree polynomial, the weighting factor for the $j^{th}$ measured value is given as a value proportional to $\{5j^2+(2m+3)j-(m+1)(m-1)\}$ where j is −m, . . . , 0, . . . m.

(2) In case where (2m+1) measured values in [−m, . . . , 0, . . . +m] are approximated as a 2-degree polynomial of the differentiation on the measured values, the weighting factor for the $j^{th}$ measured value is given as a value proportional to $\{30mj^2+(2m+3)(2m-1)j-10m^2(m+1)\}$ where j is −m, . . . , 0, . . .m.

(3) In case where (2m+1) measured values in [−m, . . . , 0, . . . +m] are approximated as a 3-degree polynomial, the weighting factor for the $j^{th}$ measured value is given as a value proportional to $\{35j^3+15(m+2)j^2-5(3m^2-5)j-3(m+1)(m+2)(m-1)\}$ where j is −m, . . . , 0, . . . m.

(4) In case where (2m+1) measured values in [−m, . . . , 0, . . . +m] are approximated as a 3-degree polynomial of the differentiation on the measured values, the weighting factor for the $j^{th}$ measured value is given as a value proportional to $\{7(3m(4m-1)+1)j^3+18m(m+2)(m-1)j^2-(3m(m(m(16m+11)-7)+5)-5)j-6m^2(m+1)(m+2)(m-1)\}$ where j is −m, . . . , 0, . . .m.

(5) In case where (2m+1) measured values in [−m, . . . , 0, . . . +m] are approximated as a 3-degree polynomial of the second-order differentiation on the measured values, the weighting factor for the $j^{th}$ measured value is given as a value proportional to $\{6(35mj^3+3(m+2)(m-1)j^2-7m(3m(m+1)-1)j+m(m+1)(m+2)(m-1)\}$ where j is −m, . . . 0, . . . m.

The component parts of the automatic player piano are correlated with claim languages as follows. The black/white keys 70 serve as "plural manipulators", and the action units 1*b*, hammers 2 and strings 4 as a whole constitute "plural tone generating units". The solenoid-operated key actuators 104 are corresponding to "plural actuators", and the plunger sensors 10, key sensors 106 or reflection type key sensors 10B serve as "plural sensors". The keystroke or current key position and key velocity are corresponding to "physical quantity". The music data codes represent "pieces of music data".

The motion controlling section 120 serves as a "noise suppressor". The registers y0-y6 are corresponding to a "temporary data storage". The motion controlling section 120 at steps SP14 and SP16 serves as an "estimator", and the motion controlling section 120 at steps SP10 and 12 serves as a "data storage controller".

What is claimed is:

1. A musical instrument for producing tones, comprising:

an acoustic musical instrument including plural manipulators respectively assigned pitch names and selectively moved for designating the pitch names of the tones to be produced, and plural tone generating units connected to said plural manipulators and producing said tones designated by means of the moved manipulators; and an electronic system including plural actuators respectively provided for said plural manipulators and selectively activated with a driving signal so as to give rise to motion of said plural manipulators, plural sensors measuring a physical quantity expressing said motion of said plural manipulators and producing detecting signals representative of measured values of said physical quantity, a preliminary processing section supplied with pieces of music data, and determining reference trajectories on the basis of said pieces of music data for the manipulators to be moved, and a motion controlling section connected to said preliminary processing section for receiving pieces of control data representative of said reference trajectories, said plural sensors for receiving said detecting signals and said plural actuators for supplying said driving signal thereto, and varying a magnitude of said driving signal so as to accelerate and decelerate said manipulators, if necessary, thereby forcing said manipulators to move on said reference trajectories, in which said motion controlling section determines the latest estimated value of said physical quantity by calculating a sum of products between said measured values of said physical quantity and weighting factors for each of said manipulators moved on said reference trajectories, and in which said motion controlling section compares said latest estimated value with a corresponding target value on the reference trajectory for said each of said manipulators to see whether or not said driving signal is to be varied in magnitude.

2. The musical instrument as set forth in claim 1, in which said measured values are approximated to a polynomial, and said weighting factors are determined on the basis of an order assigned to said measured values in a group consisting of a predetermined number of the measured values and the order assigned to the latest measured value in said group.

3. The musical instrument as set forth in claim 2, in which said measured values are approximated to a 2-degree polynomial, and said weighting factors for a velocity of said manipulators are given as $$wVj = 30mj^2+(2m+3)(2m-1)j-10m^2(m+1)$$

where j is said order assigned to each of said measured values in said group, wVj is the weighting factor for the measured value at j, m is (n −1)/2 and n is said predetermined number.

4. The musical instrument as set forth in claim 2, in which said measured values are approximated to a 2-degree polynomial, and said weighting factors for a stroke of said manipulators are given as $$wXj = 5j^2 + (2m+3)j - (m+1)(m-1)$$

where j is said order assigned to each of said measured values in said group, wXj is the weighting factor for the measured value at j, m is $(n-1)/2$ and n is said predetermined number.

5. The musical instrument as set forth in claim 2, in which said measured values are approximated to a 3-degree polynomial, and said weighting factors for an acceleration of said manipulators are given as $$wAj = 6(35mj^3 + 3(m+2)(m-1)j^2 - 7m(3m(m+1)-1)j - m(m+1)(m+2)(m-1))$$

where j is said order assigned to each of said measured values in said group, wAj is the weighting factor for the measured value at j, m is $(n-1)/2$ and n is said predetermined number.

6. The musical instrument as set forth in claim 2, in which said measured values are approximated to a 3-degree polynomial, and said weighting factors for a velocity of said manipulators are given as $$wVj = 7(3m(4m-1)+1)j^3 + 18m(m+2)(m-1)j^2 - (3m(m(m(16m+11)-7)+5)-5)j - 6m^2(m+1)(m+2)(m-1)$$

where j is said order assigned to each of said measured values in said group, wVj is the weighting factor for the measured value at j, m is $(n-1)/2$ and n is said predetermined number.

7. The musical instrument as set forth in claim 2, in which said measured values are approximated to a 3-degree polynomial, and said weighting factors for a stroke of said manipulators are given as $$wXj = 35j^3 + 15(m+2)j^2 - 5(3m^2-5)j - 3m(m+1)(m+2)(m-1)$$

where j is said order assigned to each of said measured values in said group, wXj is the weighting factor for the measured value at j, m is $(n-1)/2$ and n is said predetermined number.

8. The musical instrument as set forth in claim 2, in which said sum of products is divided by a normalizing constant so that said latest estimated value is given as the quotient.

9. The musical instrument as set forth in claim 8, in which said measured values are approximated to a polynomial, said weighting factors are determined on the basis of an order assigned to said measured values in a group consisting of a predetermined number of the measured values and the order assigned to the latest measured value in said group, and said normalizing constant is determined on the basis of said order assigned to said latest measured value in said group or both of said order assigned to said latest measured value and a sampling time period.

10. The musical instrument as set forth in claim 1, in which each of said plural manipulators is a black or white key incorporated in a keyboard of an acoustic piano, and each of said plural tone generating units includes an action unit linked with the associated black and white key, an associated hammer driven for rotation by the associated action unit and an associated string struck with the associated hammer at the end of said rotation.

11. The musical instrument as set forth in claim 10, in which said black and white keys are moved by said plural actuators provided under said black and white keys without fingering of a human player, and said plural actuators have respective solenoids energized with said driving signal and plungers projectable from and retractable into the associated solenoids for moving said black and white keys.

12. The musical instrument as set forth in claim 11, in which said plural sensors respectively monitor said plungers so as to produce said detecting signals.

13. The musical instrument as set forth in claim 11, in which said plural sensors respectively monitor said black and white keys so as to produce said detecting signals.

* * * * *